US009511974B2

(12) United States Patent
Beauduin et al.

(10) Patent No.: US 9,511,974 B2
(45) Date of Patent: Dec. 6, 2016

(54) YARN STORAGE DEVICE FOR A TEXTILE MACHINE

(75) Inventors: Charles Beauduin, Halle (BE); Vincent Lampaert, Vichte (BE)

(73) Assignee: NV MICHEL VA DE WIELE, Kortrijk/Marke (BE)

( * ) Notice: Subject to any disclaimer, the term of this patent is extended or adjusted under 35 U.S.C. 154(b) by 382 days.

(21) Appl. No.: 14/127,160

(22) PCT Filed: Jun. 20, 2012

(86) PCT No.: PCT/IB2012/001216

§ 371 (c)(1),
(2), (4) Date: Dec. 17, 2013

(87) PCT Pub. No.: WO2012/176041

PCT Pub. Date: Dec. 27, 2012

(65) Prior Publication Data

US 2014/0131499 A1 May 15, 2014

(30) Foreign Application Priority Data

Jun. 20, 2011 (BE) ..... 2011/0377
Nov. 7, 2011 (BE) ..... 2011/0652

(51) Int. Cl.

*B65H 51/22* (2006.01)
*B65H 59/22* (2006.01)
*B65H 51/20* (2006.01)
*D02H 1/00* (2006.01)
*B65H 59/36* (2006.01)

(52) U.S. Cl.

CPC ..... *B65H 51/22* (2013.01); *B65H 51/20* (2013.01); *B65H 59/225* (2013.01); *B65H 59/36* (2013.01); *D02H 1/00* (2013.01); *B65H 2701/31* (2013.01)

(58) Field of Classification Search

CPC ..... B65H 51/20; B65H 51/22; B65H 59/22; B65H 59/225; B65H 59/36; D02H 1/00
See application file for complete search history.

(56) References Cited

FOREIGN PATENT DOCUMENTS

WO 9000148 A1 1/1990

*Primary Examiner* — William E Dondero
(74) *Attorney, Agent, or Firm* — Symbus Law Group, LLC; Clifford D. Hyra

(57) ABSTRACT

A yarn storage device (1) for a yarn-processing machine including yarn storage spaces (2) and at least one yarn loader (3) which can be moved to a selected yarn storage space (2) in order to connect an end part of the yarn supply (14) to an end part of an external yarn supply, and to add an amount of yarn to said yarn storage space (2) by winding the yarn (100) onto a winding-up body (6) and then removing it from the winding-up body (6) in the wound-up state and to add it to the storage space (2). The present invention also relates to a corresponding method and a yarn-processing machine fitted with such a yarn storage device.

33 Claims, 19 Drawing Sheets

YARN STORAGE DEVICE FOR A TEXTILE MACHINE

This application claims the benefit of Belgian patent application No. 2011/0377, filed Jun. 20, 2011, and Belgian patent application No. 2011/0652, filed Nov. 7, 2011, which are hereby incorporated by reference in their entirety.

FIELD OF THE INVENTION

The present invention relates to a yarn storage device for a yarn-processing machine comprising at least two yarn storage spaces for storing a yarn supply, a yarn loader which is designed to be moved to a selected yarn storage space in order to connect an end of a yarn supply present in said yarn storage space to an end of an external yarn supply, and in order to add a certain amount of yarn in said yarn storage space.

The present invention also relates to a yarn-processing machine, in particular a weaving machine, provided with at least one such yarn storage device. In this case, each type of weaving machine is regarded as a yarn-processing machine, e.g. inter alia a face-to-face weaving machine, a pile wire weaving machine, a looped pile weaving machine and a flat weaving machine, but this also applies to, for example, a knitting machine (both a warp knitting machine and a weft knitting machine) and a beaming machine.

The present invention also relates to a method for replenishing a yarn supply for a yarn-processing machine, wherein a yarn supply is provided in at least two yarn storage spaces, and wherein the yarn supply in a selected yarn storage space is replenished by connecting an end of the yarn in said yarn storage space to an end of the yarn in an external yarn supply and then adding a certain quantity of yarn in said yarn storage space.

BACKGROUND

In the European patent EP 0 422 093, a yarn storage device is described consisting of a number of yarn storage units arranged next to one another in the form of elongate tubes in which yarn is stored in a wound-up state. Each of these tubes has an open entry side along which yarn is supplied to the yarn supply and an open output side via which the yarn leaves the tube and is taken to a yarn-processing device. The yarn loader is designed to be positioned at the entry side of a selected tube in order to replenish the yarn supply in said tube with the desired yarn. Replenishing can be carried out without interrupting the fabric-manufacturing process since new yarn can be added by connecting the free end of the yarn to be added (by tying a knot or 'splicing') to the free end of the yarn supply present in the tube.

Replenishing is carried out after the yarn ends have been connected, by forming yarn windings by means of a rotating head in the tube. The new windings push the yarn supply which is already present further into the tube.

In practice, it has been found that this way of producing windings is not suitable for every type of yarn. Only with yarns having a sufficient stiffness and roughness do the windings maintain their shape so that the windings adjoin one another without the risk of entanglement. This method does not provide a solution for yarns which per se have a limited stiffness or whose structure is smoother, because the windings are not formed in an orderly fashion or do not adjoin one another tightly, so that when they are removed at the exit side of the tube, knots and/or entanglements are formed which cannot be untangled.

In the multicoloured weaving and tufting of carpet, pile warp yarns of different colours have to be supplied to the weaving or tufting device. The consumption of said pile warp yarns depends on the design of the carpet and is thus usually not even and not identical for each pile warp thread in the fabric. As a result, the yarn storage device has to contain a separate yarn supply for each different pile warp yarn. It is known to achieve this by supplying the different yarns from respective bobbins which have been placed in a bobbin creel.

Such a bobbin creel often has to contain many thousands of bobbins and thus occupies a large amount of space, while the total amount of yarn in such a bobbin creel is also considerable. Replenishing yarns in the bobbin creel and changing yarns for carpet or velvet weaving machines is currently still done manually: (i) the used-up bobbins have to be removed from the creel and new ones have to be fitted; (ii) the thread from the new bobbin has to be tied to the previous thread and the thread has to be introduced into a guide; (iii) finally, the threads have to be retensioned again by placing small weights on the thread. In addition, thread breakages also have to be repaired manually.

The large amount of work which has to be carried out manually with a bobbin creel takes up a considerable amount of time as a result of which, the machine is non-productive for a long period of time. This is very disadvantageous for the overall efficiency of the weaving machine. In addition, this work results in significant labour costs.

SUMMARY

It is an object of the present invention to provide in such a yarn storage device for a yarn-processing machine and a method for replenishing a yarn supply for a yarn-processing machine which makes it possible to automate the time-consuming and labour-intensive activities in the bobbin creel for a large number of different yarn types.

These objects are achieved by providing a yarn storage device having the features indicated in the first paragraph of this description in which the yarn loader is designed to first wind the yarn to be added onto a winding-up body and then to remove it from the winding-up body in the wound-up state and add it to the yarn storage space.

The above objects are also achieved by providing a method having the characteristics indicated in the second paragraph of the present description, wherein the yarn to be added is wound onto a winding-up body and is then removed from the winding-up body in the wound-up state and added to the yarn storage space.

By first winding the yarns onto a winding-up body, well-formed and stable windings are produced. By introducing these windings in the yarn storage space in such a manner that they closely adjoin one another in the yarn storage space, they retain their shape well, so that they adjoin one another closely without any risk of entanglement in the yarn storage space. This also applies to flexible and smooth yarns. The yarn can be pulled from the yarn supply spaces without entanglement or the formation of knots. The yarn storage device and method according to the present invention can thus be used for virtually all types of yarns.

In this case, it is possible to first wind up the entire amount of yarn to be added in order to subsequently remove the yarn in the wound-up state of the winding-up body. However, it should be emphasized that the device and method according to the present invention also provide that yarn is removed from the winding-up body in the wound-up state and is added to the yarn storage space before all of the yarn of the amount of yarn to be added has been wound up. Thus, it is possible, for example, to remove a part (one or more yarn windings) of the yarn to be added in the wound-up state from the winding-up body while the yarn is being wound up, or during a break in the winding-up process. In a possible practical application, the yarn windings on the winding-up body will, for example, be gradually moved towards the end of the winding-up body. Once the winding-up body has been provided with yarn windings along its entire length, the front yarn windings will be pushed off the winding-up body as additional windings are being added at the rear.

In a very preferred embodiment, each yarn storage space is associated with a respective winding-up body and the yarn loader is designed to wind yarn onto the winding-up body of the selected yarn storage space and to remove at least a part of the yarn which is wound onto said winding-up body from said winding-up body in the wound-up state, so that it is added to the yarn supply.

Due to the fact that a separate winding-up body is provided for each yarn storage space, the yarn windings which have been wound onto the winding-up body do not have to be removed from the winding-up body after the yarn has been added. This avoids having to push the windings from the winding-up body by means of push-off means. As a result thereof, the risk of disturbing the shape and stability of these windings is reduced, which in turn further reduces the risk of entanglement or the formation of knots.

The windings wound onto the winding-up body can be left on the winding-up body after the yarn has been added. In an embodiment in which the windings wound onto the winding-up body are moved towards one end of the winding-up body and pushed off the latter as new windings are being added at a winding location, it is not necessary to first place windings between the winding-up location and the free end at each filling operation before adding new windings to the yarn storage space.

Preferably, the free end of a winding-up body which is associated with a yarn storage space is placed facing the yarn supply.

The last yarn windings of the yarn supply (on the side facing the supply side) can then remain in contact with the first yarn windings which are situated on the winding-up body near its free end. This contact is also maintained during the periods between two filling operations. As a result thereof, the last yarn windings of the yarn supply do not have to be retained by retaining elements during these interim periods. This contributes further to retaining the shape and the stability of the windings, resulting in a lower risk of entanglement or formation of knots.

The yarn loader preferably comprises a holder for keeping a removable winding-up body in a winding-up position.

In a particularly preferred embodiment, the winding-up body is configured in such a manner that it comprises a winding-up sleeve around an interior space and an open side via which the abovementioned holder can be introduced into said interior space in order to keep the winding-up body in the winding-up position.

The winding-up sleeve may be configured as a substantially closed surface, but may also be in the shape of two or more elongate strips or fingers which are at a distance from one another, so that an open structure is formed around the interior space.

In a particular embodiment, the yarn loader comprises an entrainment device which is designed to carry the winding-up body of a selected yarn storage space from a rest position in the yarn storage space to a winding-up position, and to place the winding-up body back into said rest position after yarn has been added to the yarn storage space.

In an advantageous embodiment, the entrainment device may be provided with at least one displaceable entrainment element, while the winding-up body is provided with one or more corresponding entrainment openings, so that each entrainment element in a recess, behind the last yarn winding, can be inserted into an entrainment opening and can be displaced substantially according to the axis of the yarn storage space in order to displace the winding-up body from the rest position to the winding-up position, or vice versa. As has already been indicated above, the contact between the various yarn windings is maintained as a result. Supplying yarn windings in this manner is efficient, simple and can easily be automated and, in addition, ensures that the shape of the pushed-off yarn windings is retained well.

In a further advantageous embodiment, the entrainment device may, optionally additionally, be designed to have a displaceable central winding axle or holder axle which is (for example, at its end) provided with gripping or pulling means in order to move the winding-up body from its rest position to the winding-up position or vice versa, and to keep it in one of those positions.

In the rest position, the winding-up body is situated in the passage via which the yarn is added. As a result thereof, this passage is largely closed off, thus preventing the yarn from the yarn supply from falling out of the storage space. The winding-up body thus serves as a closing device for the yarn storage space on which the last windings formed are still situated.

In each yarn storage space, the winding-up body is preferably connected to a fixed part of the yarn storage space in such a way that the winding-up body is axially displaceable between

- a rest position in which the winding-up body is substantially situated in the yarn storage space, in the passage via which the yarn is added, and
- a winding-up position which is axially displaced with respect to the rest position and in which at least a portion of the winding-up body (a larger portion than in the rest position) is situated outside the yarn storage space, so that it is possible to wind up yarn.

This winding-up body may, for example, be displaceably connected to an end piece which is fixedly secured in the supply passage of the yarn storage space, and forms a complete unit therewith.

In a preferred embodiment of the yarn storage device, the winding-up body may be provided with connecting elements (e.g. projections or holes) which cooperate with corresponding connecting elements (e.g. holes or projections, respectively) of the end piece of the yarn storage space. These connecting elements are able to ensure that the winding-up body remains in its rest position after the filling cycle has ended. The connecting elements preferably comprise elastically deformable parts in order to ensure that the winding-up body is positioned and secured in the rest position.

Before filling, the yarn loader will grasp the winding-up body of the yarn storage space to be filled and displace it over a short distance substantially along the axis of the yarn storage space, just enough to make space for adding yarns by means of the rotating yarn carrier.

The winding-up body may be held in its winding-up position by means of a magnetically influenceable element which is connected thereto and which can be attracted by a permanent magnet of the yarn loader. If this magnetic force is the only retaining force, it has to be greater than the counteracting force which is exerted on the winding-up body by displacement of the yarn during winding up of the yarn.

Preferably, the yarn loader is also designed to wind an amount of yarn onto the winding-up body, while the free end of the winding-up body is situated in the yarn storage space, in which case, as new yarn windings are added to the winding-up body, the yarn windings which are already present on the winding-up body are moved towards the free end and are removed from the winding-up body and added to the yarn supply in the yarn storage space.

In a particularly advantageous embodiment, each yarn storage space comprises a positioning means for positioning an end part of the yarn situated in the storage space, each winding-up body comprises a first part of the positioning means, and the positioning means comprises a second part which is fixedly arranged with respect to the yarn storage space, while the winding-up body is designed to be placed in such a position with respect to the yarn storage space that the first and the second part of the positioning means extend next to one another in a mutual position, in which said end part of the yarn is held between said first part and said second part.

In another embodiment of the yarn storage device according to the present invention, a winding-up body is not provided for every yarn storage space, but the winding-up body is an intrinsic part of the yarn loader.

In a preferred embodiment, the yarn loader comprises at least one pushing element which is designed to move the wound-up yarn or a wound-up part thereof onto the winding-up body.

The yarn storage device according to the present invention is preferably provided to partly introduce or keep the winding-up body in the yarn storage space while yarn is being added. The yarn is then pushed off the winding-up body in the yarn storage space.

Preferably, the yarn loader comprises at least one pushing element which is designed to move a wound-up part of the yarn in the axial direction on the winding-up body.

Displacement of the yarn windings is best carried out, but not necessarily, while the amount of yarn to be added is being wound up, for example, in order to clear space on the winding-up body for winding up additional yarn.

In a very preferred embodiment, each pushing element is designed to exert a substantially axially directed pushing force on the yarn. In this case, it is preferred if each pushing element is designed to move the yarn windings wound onto the winding-up body by in each case pushing against the yarn of the yarn winding which was wound up last.

As a result thereof, the yarn windings which have already been wound up can be moved in order to clear space for the subsequent yarn winding(s) on the side of the winding-up body on which yarn windings still have to be added. This may be carried out while winding up continues or during a short break in the winding-up operation.

In an advantageous embodiment, the yarn loader comprises two or more pushing elements which are designed to push, at in each case successive points in time, against successive parts of the yarn of the yarn winding which was wound up last. This makes it possible in each case to push against the yarn which was wound up last during winding up in order to move the wound-up yarn. As a result thereof, the yarn which was wound up last is being pushed several times per yarn winding, so that the yarn windings are easily moved as more yarn windings are added to the winding-up body and thus the yarn which was wound up last always closely adjoins the preceding yarn windings and also displaces these yarn windings virtually continuously, or at least with minimal intervals, on the winding-up body.

The various pushing elements are preferably arranged along the winding surface of the winding-up body at equal intermediate distances. This has the advantage that the yarn is damaged to a smaller degree since several parts of the winding are pushed forwards. Each pushing element may become operational, for example, during each winding turn. Each pushing element then preferably has a pushing cycle which has a phase shift which is fixed with respect to the winding cycle. A phase shift of approximately 180° between first contact of a part of the yarn on the winding-up body and the maximum pushing forward of this part of the yarn is preferred.

Each pushing element may, for example, carry out an axial displacement which can be described as a sinusoidal movement.

In another preferred embodiment, the yarn loader is designed to have a winding-up body which defines a winding surface for the yarn and comprises a free end via which the wound-up yarn can be pushed off the winding surface, while the transverse dimensions of the winding surface decrease in the direction of said end. As a result thereof, the yarn windings can easily slide off the winding-up body. The winding-up body has a, for example, slightly conical shape. The term transverse dimensions is intended to mean the diameter of the enveloping circle in a cross section at right angles to the longitudinal axis of the winding-up body. A winding-up body has a diameter of approximately 25 to 75 mm for the circumscribed circle of cross sections at right angles to the central axis. Preferably, this diameter is approx. 35 mm or 45 mm.

Parts which come into contact with the yarn, such as the winding-up body, feed-through elements and guide elements for the yarn, are preferably at least partly made from a wear-resistant material, such as ceramic or hardened metal, or possibly have a fitting wear-resistant cover layer. Additionally or alternatively, at least the surface which comes into contact with the moving yarn may also be provided with a cover layer which, or be made of a material which, reduces the frictional resistance between the surface and the yarn. One specific material or one specific cover layer may also increase both the resistance to wear and reduce the frictional resistance.

The winding-up body is preferably designed such that the winding surface is interrupted by at least two recesses which extend along the axis of the winding-up body. In another embodiment, the winding-up body comprises a core and at least two ribs extending radially from the core with interposed recesses, while the end faces of said ribs form the winding surface for the yarn.

Said recesses can be used for displacing push-off elements for pushing the wound-up yarn off the winding-up body, as will be explained below in this description.

Alternatively, said recesses may also be designed for displacing and positioning the winding-up body, if this winding-up body forms a separate removable part of each yarn storage space.

The yarn storage device according to the present invention preferably comprises a yarn carrier which is rotatable about the winding-up body, so that a yarn which is entrained by the yarn carrier is wound up onto the winding-up body by the rotating movement of the yarn carrier.

Preferably, the winding-up body remains stationary during winding. In an advantageous embodiment, the yarn carrier may be carried by a rotor which is concentrically rotatable about the winding-up body, and is, for example, designed as a feed-through eye.

In a particular embodiment, said device comprises at least one push-off device which is designed to push an amount of yarn off the winding-up body which has been wound up on the winding-up body while retaining the yarn windings.

In an advantageous embodiment, the push-off device may then be provided with at least one push-off element which is displaceable in a recess of the winding-up body which extends along the axis.

This embodiment inter alia makes it possible to introduce push-off means into said recesses behind the last yarn winding and to displace these, staying in said recesses, towards the end of the winding-up body along the direction of the axis of the winding-up body. As a result thereof, the push-off means push against a last yarn winding in at least two different locations, so that this yarn winding and all yarn windings situated in front thereof are entrained by the push-off means. Pushing off yarn windings in this manner is efficient, simple, can easily be automated and, in addition, ensures that the shape of the pushed-off yarn windings is retained well.

In a possible embodiment of the yarn storage device according to the present invention, each yarn storage space comprises a passage via which the yarn is added, and a detaining means having at least one detaining element which extends in the passage or in the vicinity of the passage and reduces the passage in such a manner that the yarn windings situated in the yarn storage space are kept in the yarn storage space.

Each detaining means comprises, for example, at least one detaining element which, by exerting a pushing force thereon in the direction of introduction (this is the direction in which the winding-up body is introduced into the yarn storage space), is displaceable, pivotable or elastically deformable counter to a spring force or a force exerted by the yarn which is already present, in such a manner that at least a part of the winding-up body of the yarn loader can be introduced in the yarn storage space, in which case each detaining element springs back, moves back or pivots back, after said pushing force ceases, into a position in which it keeps the yarn windings in the yarn storage space.

The detaining means comprises, for example, one or more resilient lips or a row of brush hairs which extend distributed around the edge of the passage and/or which extend from this edge in the direction of the axis of the yarn storage space and in this way prevent the yarn from falling out of the yarn storage space. The passage can easily be cleared for adding yarn, for example because the winding-up body has to be partly introduced into the yarn storage space, by deforming these elastically deformable retaining elements. The retaining elements deformed by the winding-up body have to be deformed further still until they reach a position distant from the winding-up body in order to allow the yarn to pass through when the yarn on the winding-up body is moved beyond the retaining elements. This also applies if the yarn is pushed beyond these retaining elements while pushing off a yarn supply which is present on the winding-up body.

Preferably, each yarn storage space also comprises a fixedly arranged positioning means for the positioning of an end part of the yarn which is situated in the yarn storage space.

In a preferred embodiment, the positioning means is designed in such a manner that a yarn which extends between the yarn supply and the yarn carrier can be brought into cooperation with the positioning means by rotation of the yarn carrier.

Thus, using simple means, it is possible to ensure that the end of the yarn supply is automatically available at a fixed location after each yarn supply for a subsequent yarn supply. The positioning means preferably comprises a holding means in order to hold the yarn in a fixed position.

Preferably, the positioning means is designed such that a yarn which extends between the yarn supply and the yarn carrier can only be brought into cooperation with the positioning means if the rotation of the yarn carrier has a direction of rotation which is counter to the direction of rotation of the winding-up operation.

Thus, the risk of the yarn being detained by the positioning means during winding is prevented.

In the embodiment in which a separate winding-up body is provided for each yarn storage space, said positioning means preferably cooperates with a facility on the winding-up body for clamping the thread end of the yarn supply in a fixed position when the winding-up body is returned to its rest position by the yarn loader after yarn has been added to the store.

The transverse dimensions of the winding-up body are preferably well-matched to the internal dimensions of the yarn storage space. In this case, it is best to adapt the diameter of the winding-up body to the diameter of the inscribed circle in the cross section (perpendicular to the longitudinal axis) of the yarn storage space.

The yarn itself still has to be able to pass the retaining elements. As a result thereof, the yarn windings remote from the winding-up body closely adjoin the wall of the yarn storage space, resulting in improved stability.

It is also possible to produce yarn windings which adjoin the walls of the yarn storage space so closely that the yarn which is wound onto the winding-up body at a location which is situated outside the yarn storage space, for example, by means of a yarn carrier which rotates at a larger diameter than the diameter of the inscribed circle in the cross section of the yarn storage space.

In a most preferred embodiment, the device according to the present invention comprises a programmable control unit which is designed to automatically determine, on the basis of previously input data and/or signals received from detection means provided to this end, a sequence of yarn storage spaces to which yarn has to be added, and to automatically displace and actuate the yarn loader to effect the addition of yarn in accordance with said sequence.

The present invention also relates to a yarn-processing machine, more particularly a weaving machine, a tufting machine, a knitting machine or a beaming machine, provided with at least one yarn storage device having one or more of the above-described features.

If desired, several yarn loaders may be provided per yarn storage device and thus also per yarn-processing machine, such as, for example, a weaving machine in order to be able to add yarn to a series of yarn storage spaces at a greater speed (several yarn storage spaces simultaneously).

A tandem arrangement comprising at least one yarn storage device and at least one platform with several yarn loaders (two or more) which move concomitantly is also possible. The yarn loaders then have a fixed position with respect to each other and can be displaced together by means of a common x-y movement system.

With certain types of weaving machines, such as inter alia face-to-face machines, a yarn-tensioning and recovery module is required. The yarn then runs from the yarn storage device(s), for example, through a number of flexible tubes, to the yarn-tensioning and recovery module and from there to the weaving machine.

Preferably, the winding-up body is at least partly introduced into the yarn storage space, before or during the addition of yarn. More preferably, the free end of the winding-up body is taken beyond the retaining elements before or during the addition of yarn.

Still more preferably, the winding-up body is taken to this position (at least partly in the yarn storage space or with the free end beyond the retaining elements) before or during the winding up and addition of yarn. The yarn is then also preferably pushed off the winding-up body in the yarn storage space.

In a preferred method according to the present invention, the yarn is wound onto the winding-up body in a location which is situated outside the yarn storage space.

When winding the yarn, a rotatable yarn carrier (such as, for example, a feed-through eye) has to describe a circular path around the winding-up body. To this end, a sufficiently large free space has to be provided around the winding-up body. By winding up the yarn at a location which is situated outside the yarn storage space, no free space has to be provided in the yarn storage space for this purpose, as a result of which the free space between the walls of the yarn storage space and the winding-up body can be limited to a great extent. Thus, the winding-up body can be provided with transverse dimensions which closely match (are only slightly smaller than) the transverse dimensions of the yarn storage space. Said transverse dimensions are preferably the enveloping circle of a cross section (perpendicular to the longitudinal axis) of the winding-up body or the inscribed circle of a cross section (perpendicular to the longitudinal axis) of the yarn storage space, respectively. In this case, the diameter of the enveloping circle of the winding-up body can best be adapted to the diameter of the inscribed circle in the cross section (perpendicular to the longitudinal axis) of the yarn storage space. The yarn itself also has to be able to pass the retaining elements. As a result thereof, the yarn windings which were removed from the winding-up body closely adjoin the wall of the yarn storage space. With the method according to the present invention, the yarn is also preferably wound onto the winding-up body at a location situated outside the yarn storage space for the purpose of obtaining yarn windings which adjoin the walls of the yarn storage space as closely as possible.

As a result thereof, the yarn is added in the yarn storage space in the shape of yarn windings which are only slightly smaller than the diameter of the storage space. These yarn windings are better held in their upright position due to being in contact with the walls of the yarn storage space. Thus, a yarn supply consisting of, stable yarn windings is produced. The risk of the yarn windings falling over, which would result in the formation of knots or entanglement of the yarn, is thus greatly reduced.

In addition, winding up the yarn outside the yarn storage space also offers a better view of the winding-up process, thus facilitating quality inspections.

With this method, the wound-up yarn is preferably displaced on the winding-up body as further additional yarn is being wound up. Thus, it is possible to always wind the yarn at the same location (hereafter referred to as the winding location) of the winding-up body. By displacing the wound-up yarn each time, space is being created at said winding location on the winding-up body as winding continues. By winding up at a fixed winding location, the winding-up mechanism (for example the yarn carrier) does not have to be displaced along the axis of the winding-up body.

If a detaining means is provided on the supply opening of the yarn storage space in order to detain the yarn in the yarn storage space, the passage through this detaining means naturally has to be taken into account when determining the transverse dimensions of the winding-up body. More particularly, the passage between the displaced or deformed retaining elements has to be taken into account. In this case, the fact that the yarn still has to be able to pass beyond these retaining elements while it is being displaced on the winding-up body also has to be taken into account.

With the device and the method according to the present invention, the yarn is preferably wound onto the winding-up body in such a way that the yarn windings are situated substantially next to one another. The wound-up yarn may be wound up in a spiral shape and comprise a series of successive yarn windings which are situated substantially next to one another.

In a particularly preferred method, the wound-up yarn is pushed off the winding-up body as a result of said displacement and added in the yarn storage space and in the process pushes the yarn supply which is present in the yarn storage space forward. This is inter alia the case when relatively large amounts of yarn are added, in which the winding-up body is covered with yarn windings across its entire length and the yarn windings at the front are pushed off the winding-up body as the wound-up yarn windings are displaced further so that additional windings can be added at the rear.

BRIEF DESCRIPTION OF THE DRAWINGS

The invention will now be explained in more detail with reference to the following more detailed description of a possible embodiment of a yarn storage device according to the present invention. The described device is only an example and can thus by no means be seen as a limitation of the scope of protection or of the area of application of the invention. In this detailed description, reference numerals are used to refer to the attached figures, in which:

FIGS. 2 to 7*c* show a first embodiment of a winding-up unit with a matching yarn supply tube, in which FIG. 2 shows a perspective view of the head of a winding-up unit of a yarn loader;

FIG. 3 shows a perspective view of an end piece which is provided at the supply end of each yarn supply tube and in which a number of yarn windings are present;

FIG. 4 shows a top view of a winding-up unit, the winding-up body of which is partly situated in a yarn supply tube during winding up and addition of a yarn supply;

FIG. 5 shows a perspective view of a positioning element which is provided at the supply end of each yarn supply tube in order to position the end part of the yarn supply;

FIG. 6 shows a top view of a winding-up unit with the associated pushing-off device and displaceable pushing-off pins;

FIGS. 7*a*, 7*b* and 7*c* in each case show a top view of the front part of a winding-up unit while the associated pushing-off pins in these FIGS. 7*a*, 7*b*, 7*c* are shown in successive phases when pushing wound-up yarn windings off the winding-up body;

FIGS. 12 to 17 show a second embodiment of the winding-up unit with the associated yarn supply tube, in which FIG. 12 shows a cross section of the yarn loader and a removable winding-up body in the winding-up position;

FIG. 13 shows a cross section of the yarn loader and a removable winding-up body with respect to an end piece of a yarn supply tube, in which the winding-up body is shown in the rest position and in the winding-up position;

FIG. 14 shows an assembly of an end piece and a removable winding-up body which is in the rest position;

FIG. 15 shows the winding portion of a winding unit, with a removable winding-up body in its winding-up position and without yarn windings on the central axle;

FIG. 16 shows the winding portion of a winding unit, with a winding-up body which is in the winding-up position and on which a series of yarn windings are wound on the central axle;

FIG. 17 shows a side view of a yarn loader and the winding-up body which is in the winding-up position, with respect to the end piece of a yarn supply tube, during the winding up of yarn.

DETAILED DESCRIPTION OF EMBODIMENTS

The yarn storage device illustrated in the figures is used for supplying different yarns to a yarn-processing unit, such as a weaving machine. This device is particularly suitable for storing different yarns which are used in different amounts in the yarn-processing unit. The yarns provided in the yarn storage device are, for example, the pile yarns for a weaving machine for weaving pile fabrics.

There is an external yarn supply for each different type or colour of yarn, for example, in the shape of one or more dye bobbins containing a large amount of said yarn. The different yarns (yarn types and/or yarn colours) are introduced into a number of yarn supply tubes by means of one or more movable yarn loaders. Depending on the consumption of yarn, the yarn in these yarn supply tubes is automatically replenished.

Optionally, means may be provided for automatically replacing a specific external supply by another external supply of yarn of a different type and/or colour. These means then comprise cutting means for cutting the supplied yarn from the one external supply, and positioning and connecting means for connecting an end part of the new external supply to an end part of the yarn supplied to a yarn loader. These means can preferably be automatically controlled on the basis of data relating to the respective yarn types which have to be replenished in the yarn storage spaces in order to be able to satisfy the expected yarn consumption by the yarn-processing machine.

The number of yarn supply tubes substantially corresponds to the number of colours which have to be available at a certain position, viewed in the width direction, in the fabric, multiplied by the number of positions in which the yarns are to be added in this way. For a machine for weaving pile fabrics, this number may normally correspond to the number of bobbin spindles which are traditionally provided for the pile yarns.

Figure 1:
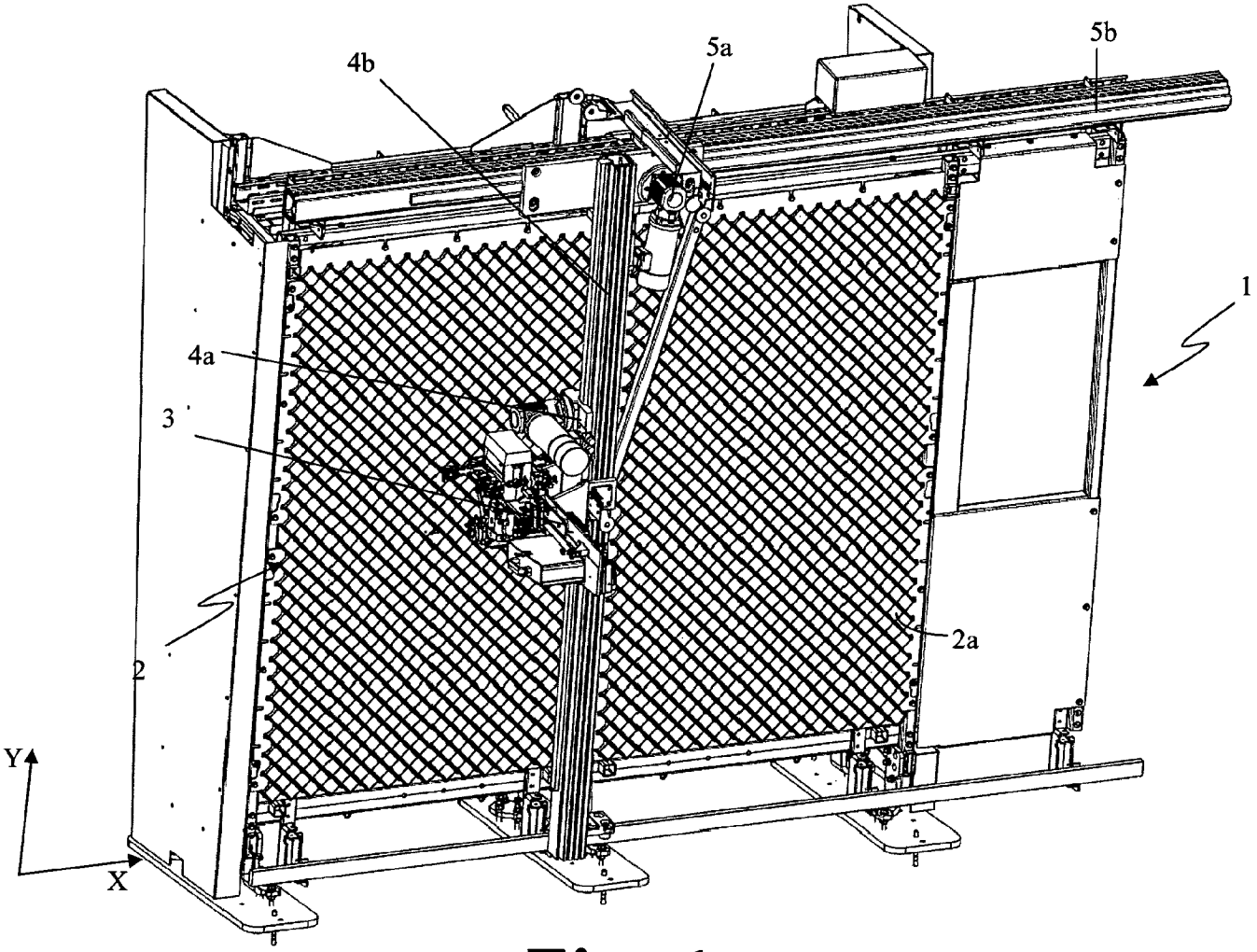
FIG. 1 shows a perspective view of a displaceable yarn loader on the supply side of the yarn supply tubes of a yarn storage device.

FIG. 1 shows an arrangement of a yarn storage device (1) according to the invention. It comprises a number of yarn supply tubes (2) which are of equal length and have a diamond-shaped cross section which are grouped into several rows of adjacent supply tubes (2) which are situated one above the other to form a substantially rectangular assembly. The various supply tubes (2) bear against each other or have common dividing walls. At the front end, each yarn storage space has a supply opening (2*a*) via which the yarn supply can be replenished. At the rear end, each storage space (2) has a discharge opening.

The ends of these supply tubes (2) are in each case in the same plane. The yarn supply tubes (2) are inclined, so that their yarn supply openings (2*a*) are at a lower level than their yarn discharge openings. On the side of the yarn supply openings (2*a*), a yarn loader (3) is arranged on a platform which can be displaced by an x-y movement system. The vertical position of the yarn loader (3) is determined by a first pinion/gear rack drive (4*a*) in which the gear rack is connected to a vertical profile (5*a*) and the pinion is driven by means of an electric motor/reductor combination.

The horizontal position of the assembly, including profile, is determined by means of a second pinion/gear rack drive (4*b*) in which the gear rack is fixedly connected to a horizontal profile (5*b*) which forms part of the frame of the yarn storage device.

At the front, the winding-up unit (31) of the yarn loader (3) comprises a fixed winding-up body (6) with a slightly conical shape. From its base, the winding-up body has a transverse dimension which gradually decreases in the direction of the free end (7) (see FIG. 2 and FIG. 6), and finally changes into a more tapered section up to the free end. The winding-up body (6) has a core (8) and a number of ribs (9) which extend radially from said core (8) and are provided with intermediate recesses (10) which extend along the length direction of the winding-up body (6) and end at the front free end of the winding-up body. The end faces of the ribs (8) form a winding surface on which the yarn (100) is wound up.

A winding-up body has a diameter of approximately 25 to 75 mm for the circumscribed circle of cross sections perpendicular to the central axle. Preferably, this diameter is approx. 35 mm or 45 mm.

The winding-up unit (31) furthermore also comprises an annular rotor (11) which is concentrically rotatable about the fixed winding-up body (6). The rotor (11) comprises a feed-through eye (11*a*) through which the yarn (100) to be wound up extends.

A series of pushing elements (12) is arranged in a concentric circle around the base of the winding-up body (6). Each pushing element (12) can be driven by a drive device (not shown) in order to be moved to and fro according to a well-defined pushing cycle in the direction of the axis of the winding-up body (6) between a front position and a rear position, hereafter referred to as the pushing position and the retracted position.

Figure 2:
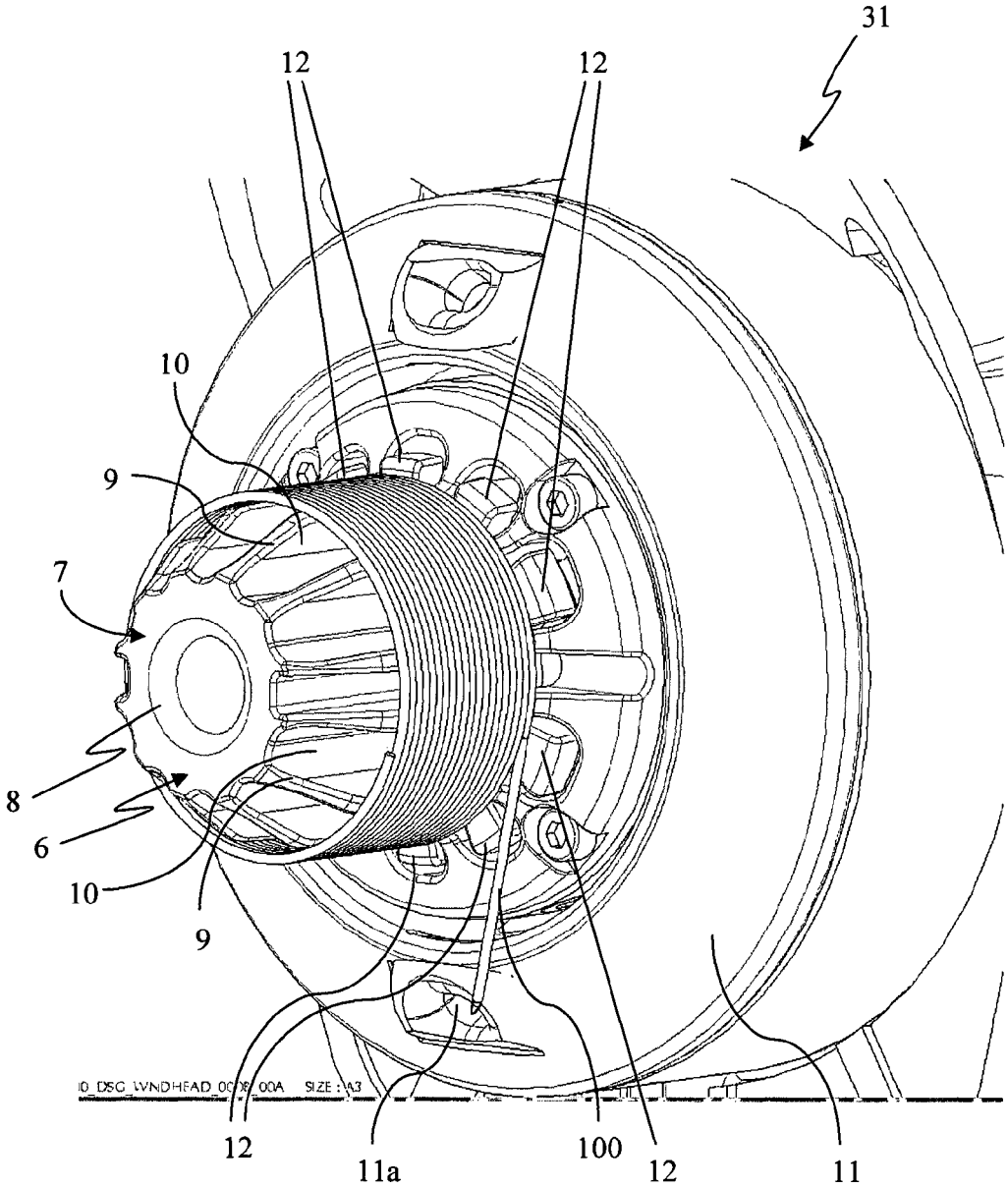

As a result of the rotation of the feed-through eye (11*a*) which carries along the yarn (100), yarn is wound onto the winding-up body (6). FIG. 2 shows the yarn windings on the winding-up body (6). Each new yarn winding is placed in virtually the same location on the conical winding-up body. This location is referred to as the winding location in the remainder of this description. The pushing elements (12) are situated behind this winding location in their retracted position. In the pushing position, each pushing element (12) is situated slightly beyond this winding location, so that each pushing element (12) can carry out a forward pushing movement in which the yarn of the winding which was added last is displaced, and as a result of which the entirety of windings on the winding-up body (6) is also moved in the direction of the free end (7) of the winding-up body (6).

The pushing elements (12) are driven according to a pushing cycle in which the pushing elements carry out a pushing movement at successive points in time, in the sequence in which they are arranged in the circle. This pushing cycle follows the winding cycle with a slight delay, wherein a pushing element (12), for example, in each case carries out a pushing movement at the instance when the feed-through eye (11*a*) with the yarn (100) is situated diametrically opposite the location of the pushing element (12).

The pushing elements (12) do not rotate about the winding-up body, but each of them performs a swinging movement in a plane which intersects the axis of rotation (11*b*) of the rotor (11). The pushing elements (12) are, for example, mounted (see FIG. 11) on a bearing (99) which is at an angle with respect to the axis of rotation of the rotor (11) and the inner ring (99*a*) of which co-rotates with the feed-through eye (11*a*) about the same axis of rotation.

The wound-up yarn (100) is gradually moved to the free end (7) and is ultimately pushed off. The slightly conical shape of the winding-up body (6) facilitates this pushing-off operation by the pushing elements (12).

The pushing elements (12) move in the recesses (10) mentioned above. In these recesses (10), room is also provided for the pushing-off pins (22) of the pushing device (21) which will be described further below.

At the position where the feed-through eye (11*a*) places the next length of yarn (100) (referred to above as the fixed winding location), the winding-up body (6) has flanks which ascend steeply in the direction of the rotor (11). The newly wound-up yarn first ends up on these flanks and is then guided downwards by these, as a result of which the yarn ultimately ends up on said winding location on the conical part of the winding-up body (6).

At least at the location where the next yarn length is added, the pushing elements (12) are in the retracted position, away from the free end (7) of the winding-up body (6). The above-described pushing movement executed by the pushing elements (12) thus takes place after said yarn length has been positioned on the slightly conical part of the winding-up body (6) by the abovementioned flanks.

Figure 3:
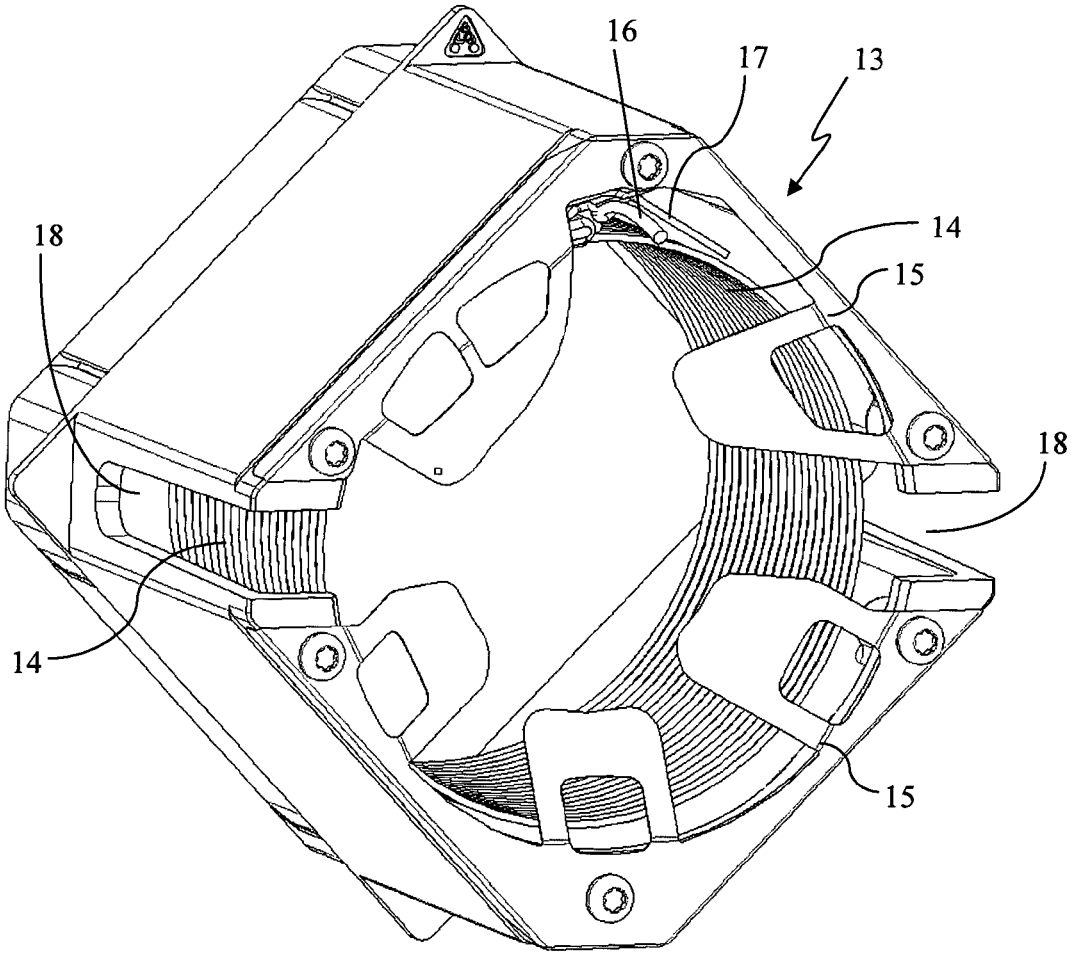

The yarn supply opening (2*a*) of each yarn storage space (2) is provided with a separate end piece (13) which is designed to keep the yarn supply (14) in the yarn supply tube (2) while also making it possible to add a subsequent amount of wound-up yarn. In FIG. 3, the end piece (13) is shown in the situation after the replenishing operation in a yarn supply tube has been completed: the yarn supply (14) is situated entirely behind the flexible leaf springs (15) which are bent towards the inside in the direction of the yarn discharge side. The end part (16) of the yarn supply (14) is situated in a positioning element (17) which is attached at the location of the outer edge of the yarn supply tube (2). This positioning element (17) is provided in order to keep the end part (16) of the yarn supply (14) in a fixed position for a subsequent replenishing operation and will be described in more detail below with reference to FIG. 5.

The end piece (13) also has one or more lateral openings (18) which form a passage for the pushing-off pins (22) of the pushing-off device (21). After the desired amount of yarn has been wound up, the yarn windings present on the winding-up body (6) can thus be pushed beyond the leaf springs (15) by these pushing-off pins (22). During this pushing-off operation, these pushing-off pins (22) also move in the lateral openings (18) of adjacent yarn supply tubes (2).

Figure 4:
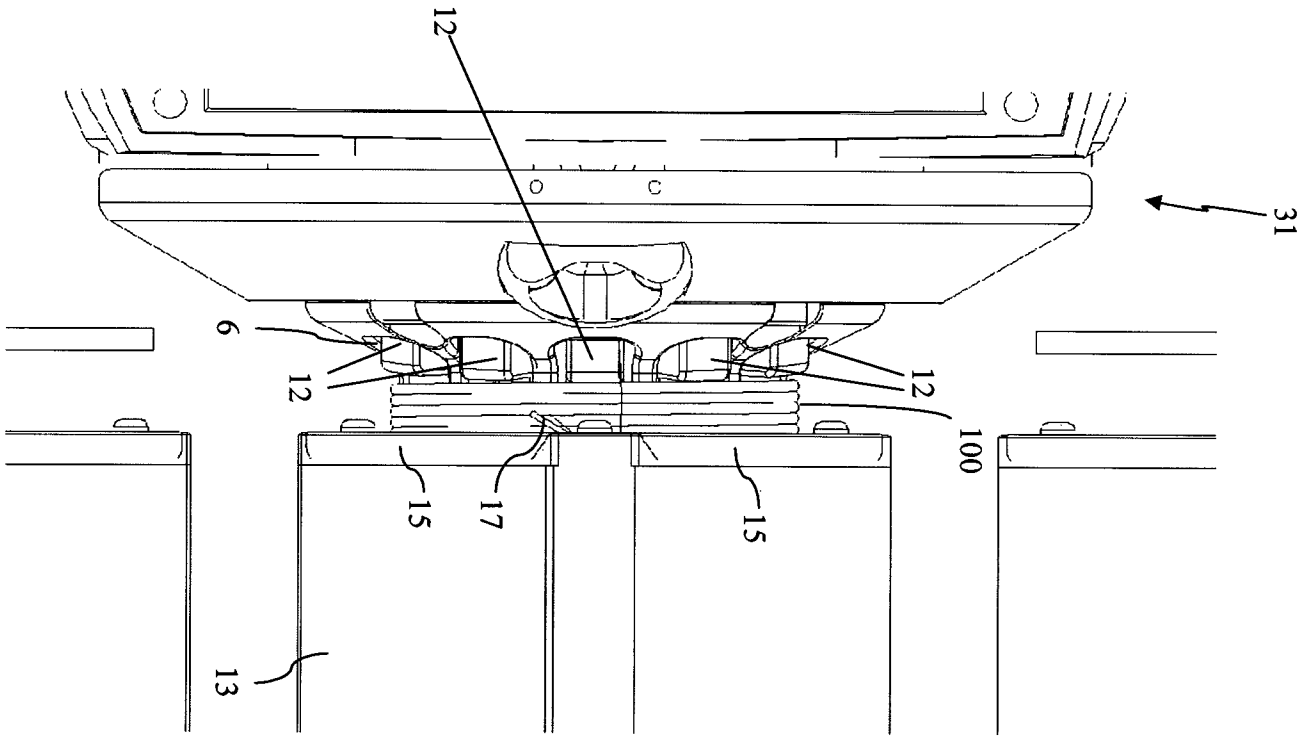

During the addition of yarn in a yarn supply tube, the winding-up body (6) and the feed-through eye (11*a*) with the associated drive are in the position illustrated in FIG. 4. The rotor (11) of the feed-through eye (11*a*) is driven via a servomotor, more particularly this may be a permanent-magnet motor.

The feed-through eye (11*a*) is situated outside the yarn supply tube (2) and the front part of the winding-up body (6) is situated in the yarn supply tube (2). However, the yarn is wound onto the winding-up body (6), on the part of the winding-up body which is situated outside this yarn supply tube (2). During further winding, these windings are pushed forwards by the pushing elements (12) in the axial direction until they reach the part of the winding-up body (6) which is situated inside the yarn supply tube (2), where these windings are finally pushed off the winding-up body (6) and end up in the yarn supply tube (2) in the wound-up state.

FIG. 4 shows the position in which the feed-through eye (11*a*) which carries the yarn (100) is situated on the non-visible bottom side; on this bottom side, the (non-visible) pushing elements (12) are removed from the last yarn winding, so that room is made for the next winding; on the top side of the feed-through eye (11*a*) can be seen that the pushing elements (12) do push against the previously produced winding and therefore displace this winding (and the complete packet of windings on the winding-up body) in the direction of the free end (7) of the winding-up body (6).

Figure 11:
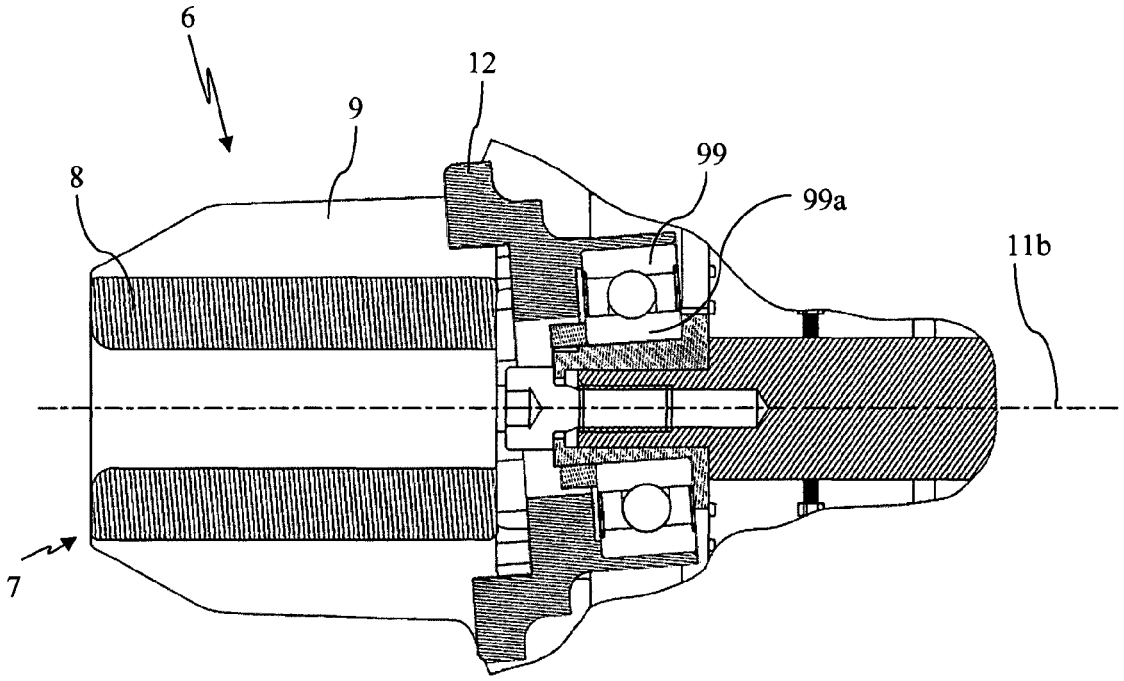
FIG. 11 shows an advantageous embodiment for the pushing elements of the device.

FIG. 11 shows a preferred embodiment for driving the pushing elements (12). The pushing elements (12) are connected to one another and can only move in a plane which intersects the axis of rotation (11*b*) of the rotor (11). The pushing elements are driven in a swinging manner due to the fact that they are mounted on a bearing (99),

- whose point of mass inertia is situated on the axis of rotation (11*b*) of the rotor (11), and
- whose central axle is at an angle to the axis of rotation of the rotor (11), but
- whose inner ring (99*a*) is connected to parts which co-rotate about the central axis of rotation (11*b*) of the rotor (11).

Figure 5:
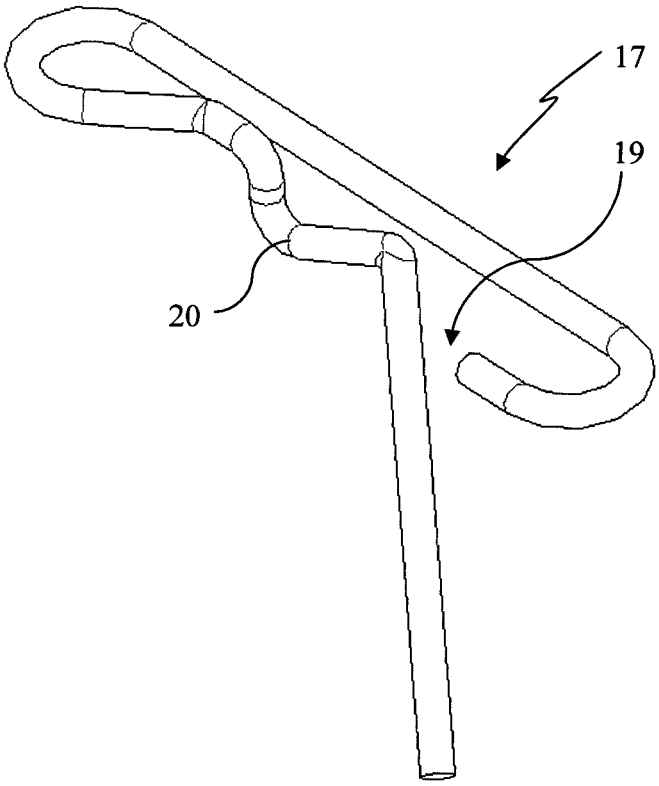

FIG. 5 shows the abovementioned positioning element (17) in detail. It is a thread-like element (17) which is bent in such a manner that a partly surrounded and laterally accessible loop opening (19) is formed, so that the yarn can be inserted laterally into the loop opening and is held in a fixed position in a curve (20) of the thread-like element (17).

If the yarn (100) extending between the yarn supply (14) and the feed-through eye (11*a*) is carried along at a direction or rotation which is counter to the winding-up direction of rotation, the yarn (100) ends up laterally in this loop opening (19) via the open side of the loop opening (19) and is detained in said curve (20). If the yarn (100) is rotated at the winding-up direction of rotation during the winding-up process, it cannot end up in the loop opening of the positioning element (17) as the yarn then approaches the loop opening (19) from the side from which this loop opening (19) is not accessible. Undesired retaining of the yarn (100) during winding up can therefore not occur.

The fact that the loop opening (19) is only accessible at a direction of rotation which is counter to the winding-up direction of rotation is thus used to rotate the yarn at the end of the winding cycle for a short time in the opposite direction of rotation (counter to the winding-up direction of rotation) in order thus to introduce the yarn into the positioning element (17) and position it at a fixed location of the yarn supply tube (2). Subsequently, the yarn is cut, as a result of which an end part (16) of the yarn supply (14) remains behind in the positioning element (17). Then, the yarn loader (3) is moved to the next yarn supply tube (2) to be replenished.

The yarn supply tubes (2) to be replenished and their sequence are determined by a programmable control unit (not shown) on the basis of input control data and/or on the basis of a calculation of the yarn supply which is present and the anticipated yarn consumption per yarn supply tube, and/or on the basis of detection signals from detectors which are provided for this purpose (not shown). Such detectors detect, for example, when the amount of yarn in a yarn supply drops below a specific minimum.

Figure 6:
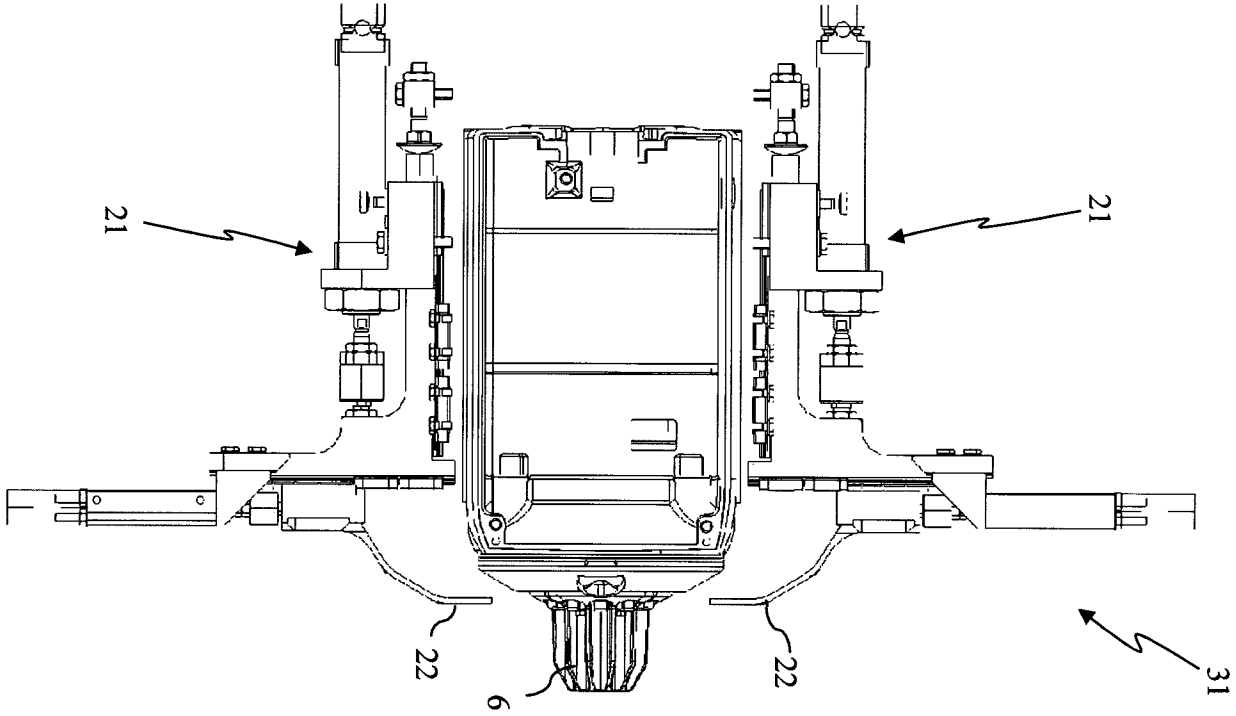

FIG. 6 shows the feed-through eye (11*a*) and its drive in top view. The winding-up body (6) and the adjacent displaceable pushing-off pins (22) of the pushing-off mechanism (21) with its associated driving features, more particularly pneumatic cylinders which control the various movements of the entrainment pins (22) can be seen clearly.

Figure 7A:
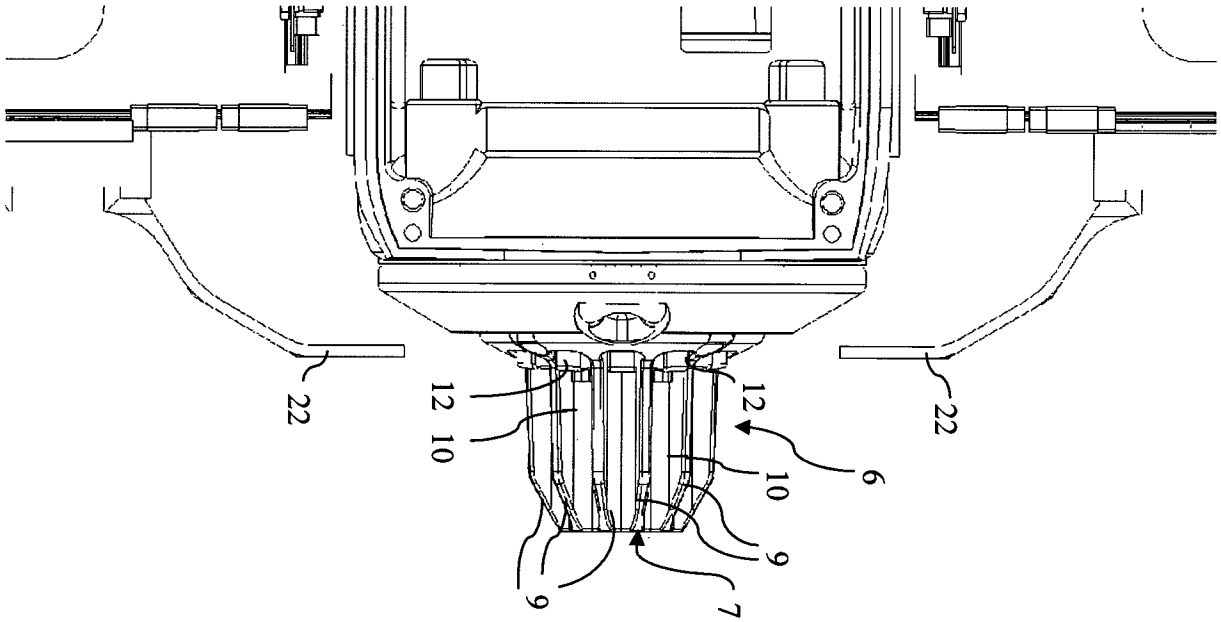
Figure 7B:
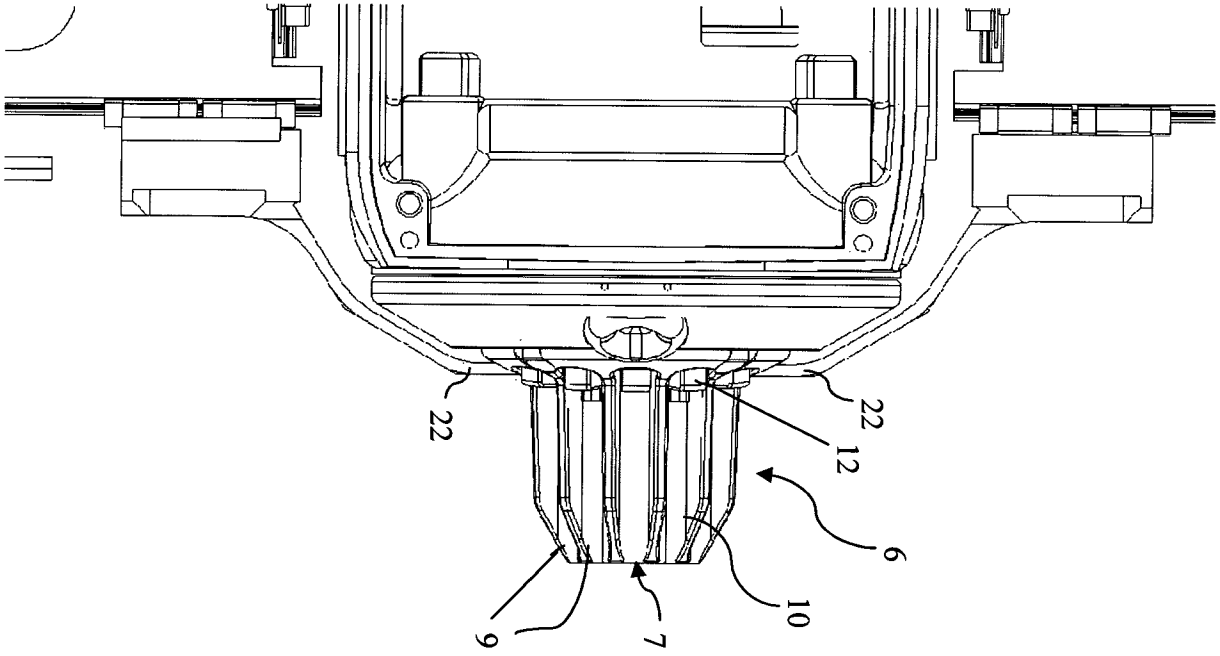
Figure 7C:
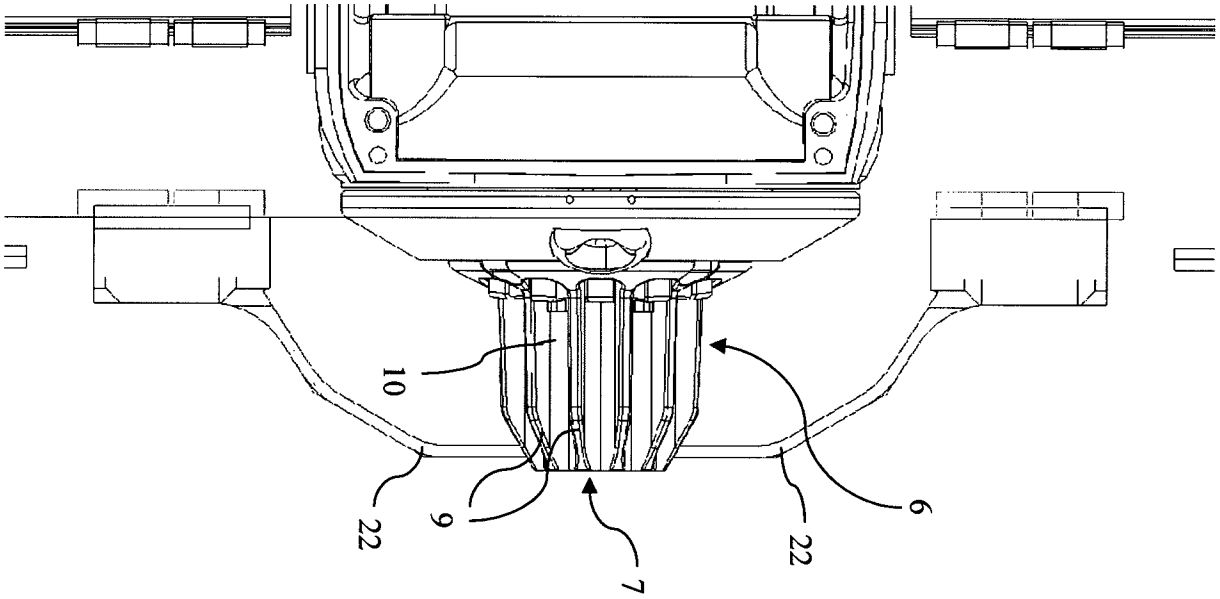

FIGS. 7*a*, 7*b* and 7*c* show three different positions of the pushing-off pins (22) during their operation. FIG. 7*a* shows the rest position of the mechanism, for example, during winding of the yarns onto the winding-up body (6).

In the situation in FIG. 7*b*, the pushing-off pins (22) are moved radially towards each other in the direction of the axis of rotation of the rotor (11) of the feed-through eye (11*a*), so that the ends of these pushing-off pins (22) have ended up in the recesses (10) in the winding-up body (6), behind the yarn windings which are still to be pushed off the winding-up body (6).

FIG. 7*c* shows the situation in which the pushing-off pins (22) have been moved in the direction of the axis of the winding-up body (6) up to the free end (7) of the winding-up body (6). This is the movement which is carried out in order to push the last part of the amount of wound-up yarn off the winding-up body (6) and into the yarn supply tube (2) beyond the bent leaf springs (15).

Figure 8:
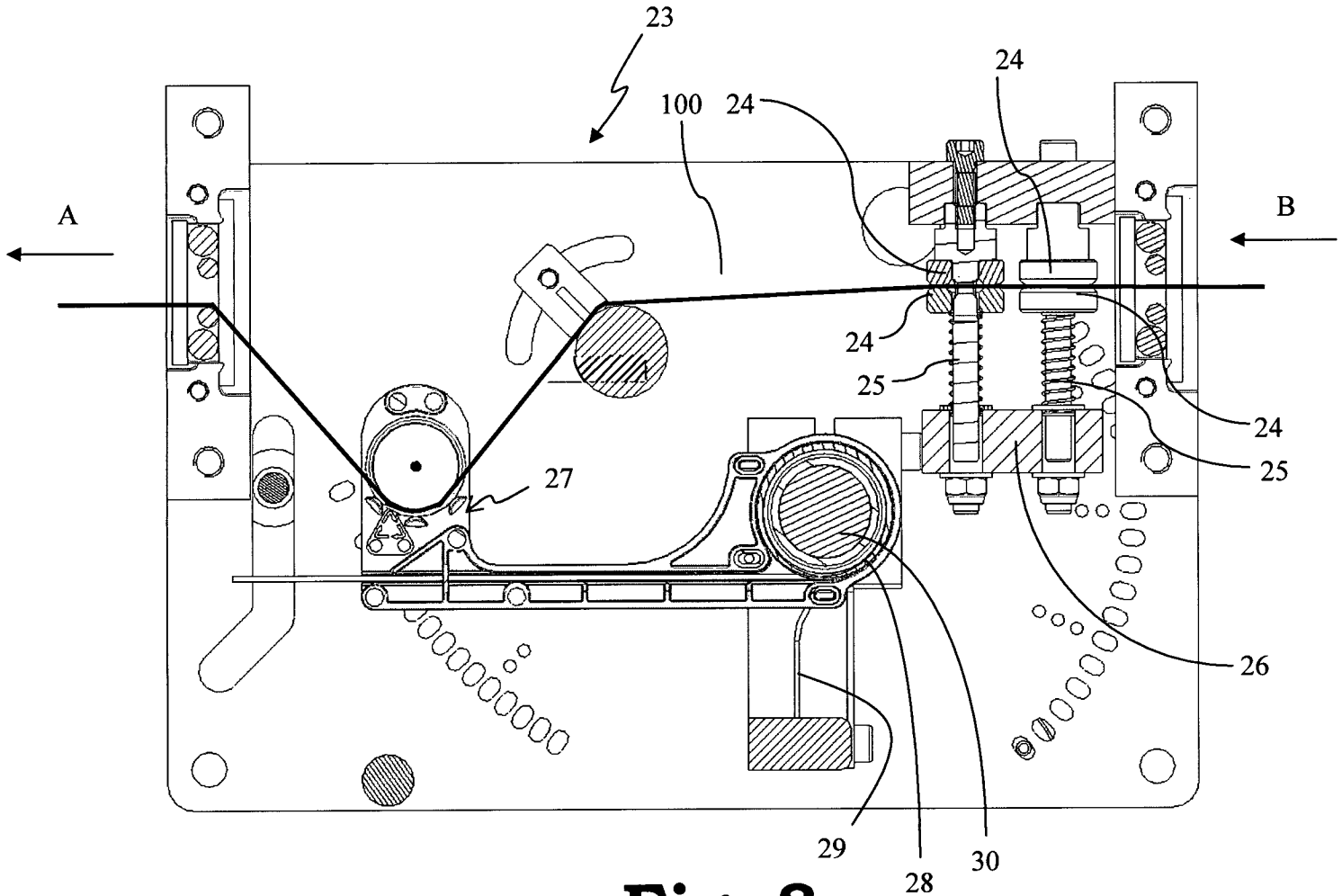
FIG. 8 shows a diagrammatic cross section of a tensioning and recovery device for supplying yarn to a weaving machine.

An embodiment of a tensioning and recovery system (23) associated with this yarn storage device (1) is shown in cross section in FIG. 8. This system is required in case the yarn-processing machine processes yarns under tension and by means of shed forming, such as for example weaving machines for weaving pile fabrics, more specifically double-face weaving machines, pile wire weaving machines and loop pile weaving machines.

Arrows A and B (see FIG. 8) show the overall direction in which the yarn moves, although it is also possible to detect a temporary return movement in position A, connected to the recovery because of the shed-forming mechanism. In position B, the yarn arrives from the yarn storage device, optionally guided in guide tubes (not shown). In position A, the yarn continues in the direction of the yarn-processing machine, for example, a weaving machine, tufting machine, knitting machine or beaming machine.

The tensioning and recovery system (23) has to be provided with a tensioning system comprising one or more tensioning elements, in each case supplemented by a recovery element; the tensioning element consists of a combination of two dish-shaped elements (24) between which the yarn runs (see FIG. 8) and in which an adjustable compression spring (25) builds up the tension. Other systems for building up the tension, such as leaf springs which push the yarn against a fixed surface, weights, pneumatic pistons or magnetic elements, may also be taken into consideration. Here, the recovery element is a lever (27) which temporarily stores the amount of yarn (100) which is moving backwards due to shed-forming by means of an adjustable torsion spring (28). The torsion spring (28) may be adjustable in order to change its equilibrium position or to change its stiffness. As recovery element it is also possible to use a weight, a pneumatic piston, or a magnetic element.

Preferably, a number of these tensioning and/or recovery elements can be controlled in a group. For the tensioning system (24, 25), this is provided by adjusting the length of the compression springs (25) of a group of tensioning elements (24) by means of a common control profile (26). In a leaf spring system, the fastening point of the leaf springs may be provided on a common axle which can be rotated in order to achieve a desired tension. For the recovery system (27, 28), this is provided by, with a group of recovery elements, adjusting the positions of the similar ends (29) of the torsion springs (28) together around the central axle (30) on which the torsion springs (28) are mounted.

Figure 9:
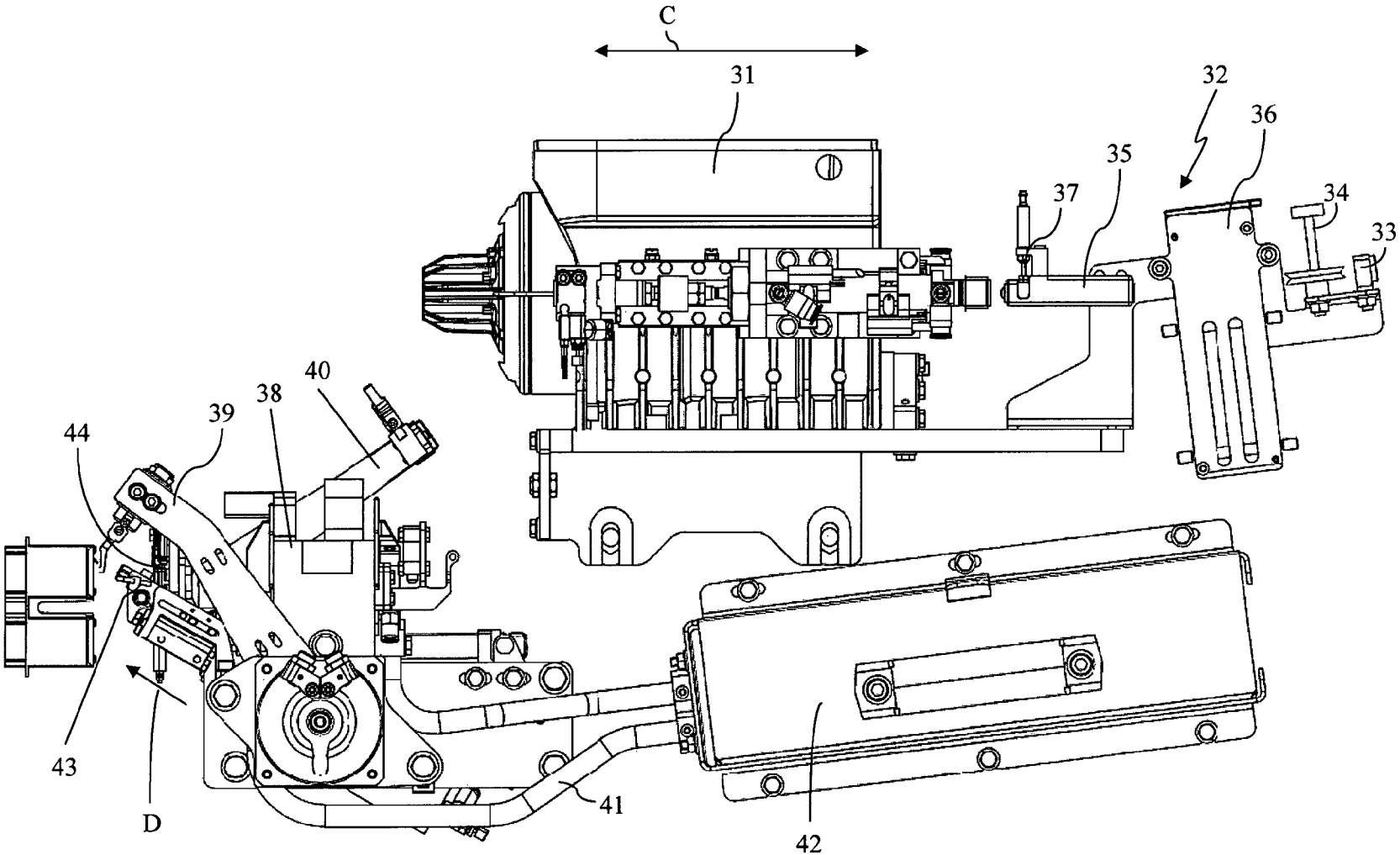
FIG. 9 shows a side view of a yarn loader according to the present invention.

FIG. 9 shows all the components of the yarn loader (3) together with the platform which can be displaced by means of the X-Y movement system, opposite an end piece (13) on the yarn supply opening (2*a*) of a yarn supply tube (2) selected by the control program.

These components include a winding-up unit (31) with winding-up body (6), pushing elements (12), yarn feed-through eye (11*a*) and the pushing-off mechanism (21) attached to this winding-up unit (31). In addition, these components also include a yarn supply module (32) with a supply eye (33), a supply tensioner (34), a blow-back unit (35) (such as, for example, a venturi unit) to blow the yarn back in the direction of the external yarn supply, a supply recovery cell (36) which can keep the amount of yarn which has been blown back taut, via a number of deflections about one or more weights or resilient elements, so that it does not become entangled, and also a controlled supply clamp (37). This assembly of winding-up unit (31), pushing-off mechanism (21) and yarn supply module (32) is also displaceable with respect to the platform in a direction C (see arrow in FIG. 9) in the length direction of the yarn supply tubes (2). This direction is substantially perpendicular to the plane of the X-Y movement, so that the winding-up body (6) can move in and out of the selected yarn storage space (2). In a variant embodiment, the yarn supply module (32), or only the supply tensioner (34), may be fixedly arranged on the platform which by means of the X-Y movement system, as a result of which these are only displaceable according to the movement of the X-Y movement system. This variant embodiment ensures that less yarn has to be recovered by the supply recovery cell (36), so that this can be made more compact and less complicated.

The other components which are supported by the platform on which the yarn loader (3) is located are:

- a connecting unit (38), in this case a knotting unit, provided with the necessary detection means,
- two associated yarn grippers, a front yarn gripper (39) and a rear yarn gripper (40),
- a waste remover (41) which sucks up the yarn ends which have been cut off after knotting and takes them to a collecting point (42).
- a sucking unit (43) which can be moved to and fro in the direction indicated by arrow D in order to suck in the end part (16) of the yarn in the yarn supply (14) and to keep it taut, and
- a cutting and clamping unit (44) which cuts the yarn (100) which is still connected to the external yarn supply after supply of the yarn in a yarn supply tube (2) has stopped and retains the yarn end which is connected to the external yarn supply in a clamped manner.

Figure 10B:
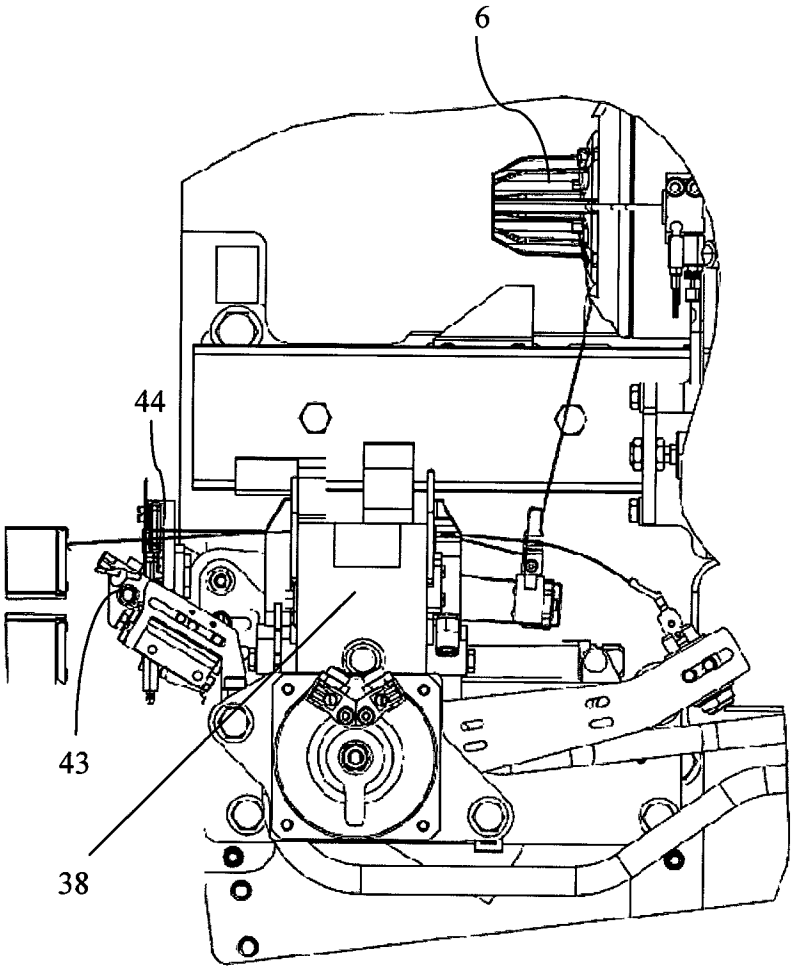
FIGS. 10*a* and 10*b* respectively show a perspective view and a side view of a part of the yarn loader from FIG. 9 during operation.
Figure 10A:
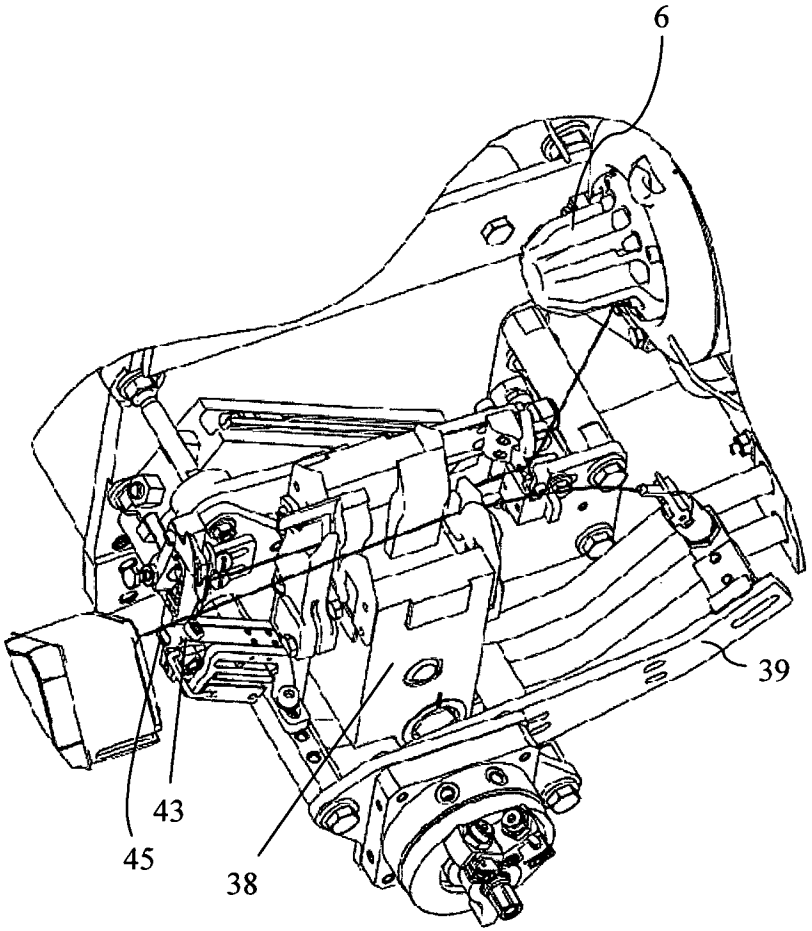

FIGS. 10*a* and 10*b* show the principle of connecting the external yarn supply to the yarn supply (14) of the yarn supply tube (2) selected by the control program. In a specific embodiment, the end parts of these yarns are tied together by means of an automatic knotting unit (38). This knotting unit can produce connections in which the end parts of yarns to be connected are in the same direction or in the opposite direction prior to the connection being made. Typical knots are single and double sheet bend, fisherman's knot and other knots. Rather than using a knotting apparatus, it is also possible to use a splice unit. This connects the yarns by blowing air at high pressure through the two assembled end parts by means of an air blast, so that the fibres of both yarns become entangled with each other.

A typical cycle for introducing yarn into a yarn supply tube (2) comprises the following steps:

1) The platform on which the yarn loader (3) is situated moves to a subsequent position in order to start the filling cycle of the yarn supply tube (2) which has been selected by the control program;
2) The sucking unit (43) moves to a position close to the positioning element (17) of the selected yarn supply tube (2) on a rectilinear guide and sucks the end part (16) of the yarn supply (14) which is present therein into its suction opening (45) and pulls the yarn along over a short distance in a direction opposite the direction which is indicated in FIG. 9 by arrow D;
3) The front gripper (39) takes the yarn-end part (16) between the positioning element (17) and the suction opening (45) of the sucking unit (43), and moves it, for example, by means of a rotating movement, by means of a pneumatic or electric motor in such a manner that a yarn length from the yarn supply (14) which was already present is pulled from the yarn supply tube (2) and is placed in the connecting unit (38). At the same time, the end part of the yarn which comes from the external yarn supply is ready in the connecting unit (38), as it was placed here during a previous yarn supply cycle (see below);
4) The clamping element of the cutting and clamping unit (44) is opened and the clamping element of the front gripper (39) is opened;
5) The two yarns are connected in the connecting unit (38), while the waste resulting from this connecting operation is sucked up by the waste remover (41) which, for example, consists of two suction lines which suck in the yarn parts which have been cut off after a knot has been tied and take them to the collecting point (42);
6) The blow-back unit (35) is switched on and sucks in the thread so that the latter is taut. In this case, the yarn windings present in the yarn supply tube (2) are not sucked out of the storage space due to the fact that they are pushed against the leaf springs (15) of the end piece (13). This pressure results from the inclined position of the yarn supply tube (2) in combination with a pressure element (not shown) which is provided on the discharge side of the yarn supply (14) which is present, and which presses against the yarn supply (14) on account of the force of gravity of a sliding or rotating element such as a ball which bears against this pressure element;
7) The yarn loader is moved until the winding-up body (6) is in line with the selected yarn supply tube (2);
8) The connecting unit (38) is made ready for a subsequent connecting operation;
9) The rotor (11) rotates the feed-through eye (11*a*) in the winding-up direction of rotation until the feed-through eye (11*a*) is at the top;
10) The winding-up unit (31) is introduced into the end piece (13) of the yarn supply tube (2) with the front part of the winding-up body (6) so that the slightly conical part of the winding-up body (6) protrudes beyond the leaf springs (15) which have been elastically deformed through contact with the winding-up body (6) in the direction of the discharge side of the yarn supply tube (2).
11) The supply clamp (37) is closed and the blow-back unit (35) is switched off.
12) The yarn is pulled from the positioning element (17) by a rotation of the supply eye (11*a*) in the winding-up direction of rotation until this feed-through eye (11*a*) is returned to the bottom position, after which the supply clamp (37) is re-opened.
13) The intended number of windings is now first wound up onto the winding-up body (6) by rotating the feed-through eye (11*a*) in the winding-up direction of rotation. During this rotation, it is impossible for the yarn to end up in the positioning element (17). This winding-up takes place outside the storage space (2). The yarn windings are moved onto the winding-up body (6) as far as the part which is situated in the yarn supply tube (2); after all, while the yarn supply is being built up, the pushing elements (12) always push the parts of the yarn winding which have been added last forwards, so that these come to lie against the previous windings and so that the wound-up supply is being pushed forwards in the direction of the free end (7) of the winding-up body (6). During winding, the yarn is supplied from the external yarn supply via a supply tensioner (34) which provides the correct tension for producing the windings; if desired, this supply tensioner (34) may be controlled as a function of the properties of the yarn (100) to be supplied. Subsequently, the supplied yarn passes through the winding unit (31) in which case it initially runs along the central axis of rotation of the feed-through eye (11*a*) and then turns off into an oblique duct and runs to the feed-through eye (11*a*).
14) After the desired amount of yarn has been laid, the pushing-off pins (22) of the pushing-off mechanism (21) are moved radially towards each other in the direction of the central axle of the winding-up body (6), by means of a pneumatic piston or via a linear motor. The pushing-off pins (22) thus reach behind the winding which was added last into a recess (10) in the winding-up body (6).
15) The pushing-off pins (22) are then moved in the axial direction along the length direction of the winding-up body (6) towards the free end (7) and push the windings which are still present on the winding-up body (6) off the winding-up body. In this case, these yarn windings are pushed beyond the leaf springs (15) of the end piece (13) which is situated on the supply side of the yarn supply tube (2). This is possible by the fact that the pushing-off pins (22) can be moved beyond these leaf springs (15) into a respective lateral opening (18) of the end piece (13) (see FIG. 3).
16) After the blow-back device (35) has been activated, the feed-through eye (11*a*) is rotated in the direction of rotation which is counter to the winding-up direction of rotation, just beyond the top position of the feed-through eye (11*a*). Partly due to the position of the windings which have already been pushed off by the pushing-off pins (12) and detained, the yarn (100) which extends from this yarn supply to the feed-through eye (11*a*) is introduced into the loop opening (19) of the positioning element (17) by this rotation.

17) Thereafter, the blow-back device (35) is switched off, the pushing-off pins (22) are returned to their original position, in which they are first moved backwards in the axial direction, counter to the yarn supply direction, and then again in the radial direction, away from the axis of the winding-up body.

18) The winding unit (31) and the components fixedly attached thereto now move away from the yarn supply tube (2) again, while the yarn remains in the positioning element (17). The feed-through eye (11*a*) now continues to rotate in a direction of rotation counter to the winding-up direction of rotation so that the yarn comes to lie just above the connecting unit (38) which is accessible from above.

19) The yarn loader (3) then moves upwards, so that the yarn ends up in the cutting and clamping unit (50). The clamping element of the rear yarn gripper (40) grips the yarn which extends between the yarn supply tube (2) and the feed-through eye (11*a*) and places the yarn ready in the connecting unit (38).

20) Then, the yarn is cut and the part which is connected to the external yarn supply is held in a clamping manner in the clamping element of the cutting and clamping unit (44).

In order to achieve a first filling of such a system, a number of steps have to be modified as no yarn supply end (16) is available in the positioning element (17).

The following actions have to be carried out:

a) The platform on which the yarn loader (3) is situated is moved until the winding-up body (6) is in line with the yarn supply tube (2) to be filled;

b) The feed-through eye (11*a*) is rotated into its top position;

c) The clamping element of the rear yarn gripper (40) is opened;

d) An elongate object with a hook or an eye is introduced into the empty yarn supply tube (2) from the yarn discharge side, so that the hook or the eye protrudes on the supply side of the yarn supply tube (2).

e) The yarn is pulled out of the clamping part of the cutting and clamping unit (44) and fastened on the hook or the eye.

f) The elongate object is then pulled from the yarn supply tube (2) and the yarn end is in this case placed beyond the discharge side of the yarn supply tube (2);

g) The pressure element and the associated adjacent sliding or rotating element (see above) are introduced into the yarn supply tube (2) on the discharge side and moved against the leaf springs (15);

h) The yarn is then maintained in a taut state on the discharge side and the winding-up unit (31) is moved until the winding-up body (6) has reached its winding position in the yarn supply tube (2);

i) The operations described above in actions 13 to 20 can now be carried out in the normal operating sequence.

Figure 12:
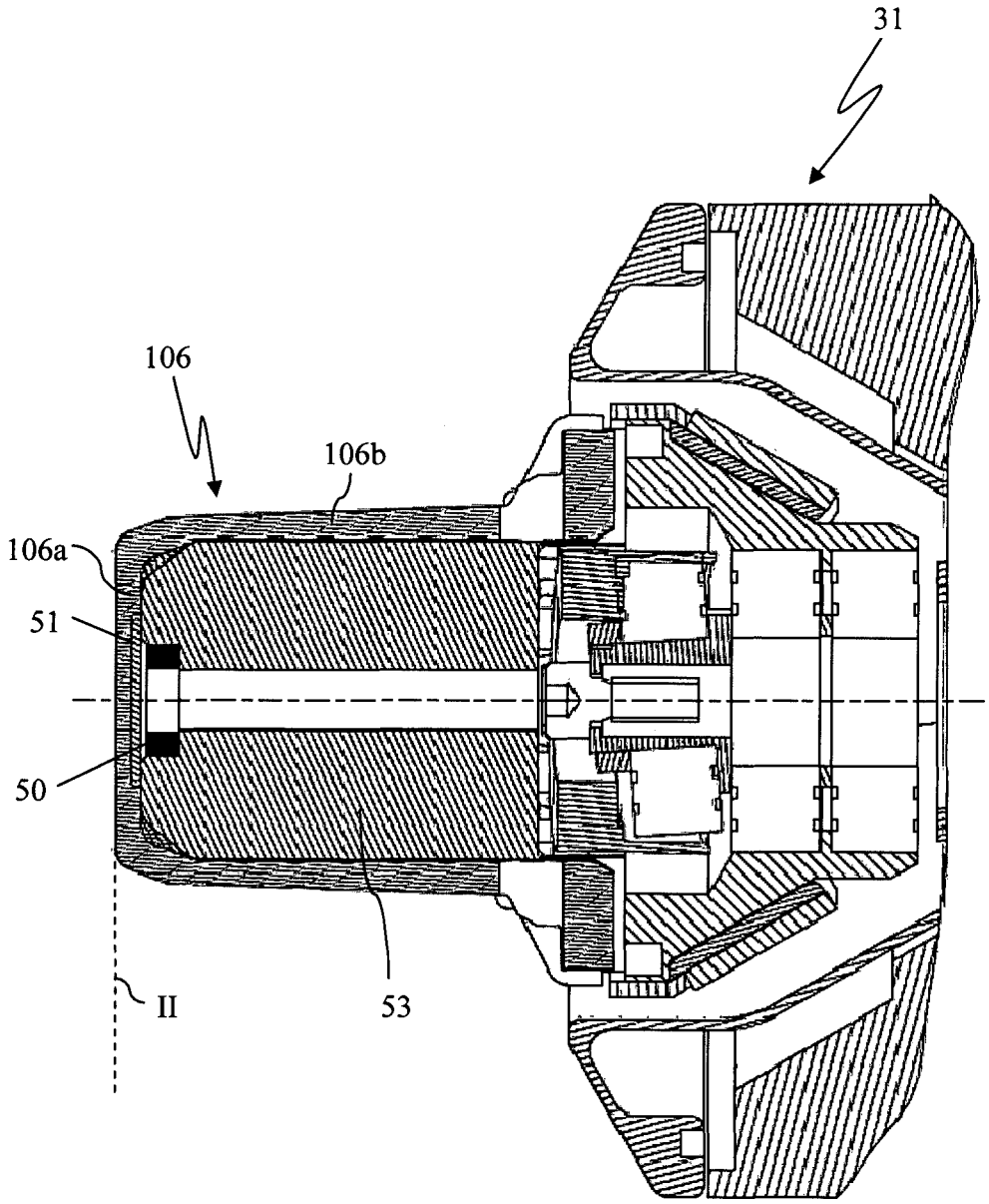

The embodiment from FIG. 12 et seq. shows a yarn loader (3) and the associated parts in which the winding-up body (106) is designed as a sleeve-shaped element with a closed side (106*a*) and a number of fingers (106*b*) which adjoin the peripheral edge of this closed side (106*a*) and are distributed along this periphery and which form a winding-up sleeve together around an interior space, and an open side which is situated opposite this closed side (106*a*) and via which said interior space between the fingers (106*b*) is accessible.

On its winding-up axle, the winding-up unit (31) of the yarn loader (3) comprises a holder (53) which extends into said interior space via the open side, so that the winding-up body (106) is supported by the holder (53). Here, the winding-up body (106) is in the winding-up position (II). The winding-up body (106) can be displaced from this winding-up position (II) into a rest position (I), in which the winding-up body (106) is connected to an end piece (113) of a yarn supply tube (2), as is described below with reference to FIG. 13.

In the figures, the winding-up body (106) is shown in the rest position and the winding-up position and these positions are indicated by means of a dashed line (I), (II) which is in line with the closed side (106*a*) of the winding-up body. In this patent application, the reference numerals (I), (II) of these dashed lines are also used to refer to the rest position (I) and the winding-up position (II). In this embodiment, the above-described pushing-off pins (22) are designed to carry the winding-up body along.

Here, the yarn loader (3) with its pushing-off pins (22) is placed at a certain angle with respect to the horizontal (e.g. an angle between 5° and 20°, typically approximately 13.5°) in order to allow the pushing-off pins (22) to move freely between the adjacent tubes, more particularly without touching the associated removable winding-up bodies or removable parts of winding-up bodies.

The holder (53) is provided with positioning elements, such as for example longitudinal grooves with which corresponding ribs of the removable winding-up body (106) engage in such a manner that no undesired rotation of this winding-up body (106) with respect to this holder (53) can take place. In addition, the holder (53) also comprises a first retention means (50) which is designed to cooperate with a second retention means of the winding-up body (106) in order also to keep this winding-up body (106) in position axially. In the embodiment from FIG. 12, the holder (53) comprises a permanent magnet (50) to this end, which acts on a magnetisable part (51) of the removable winding-up body (106).

Figure 13:
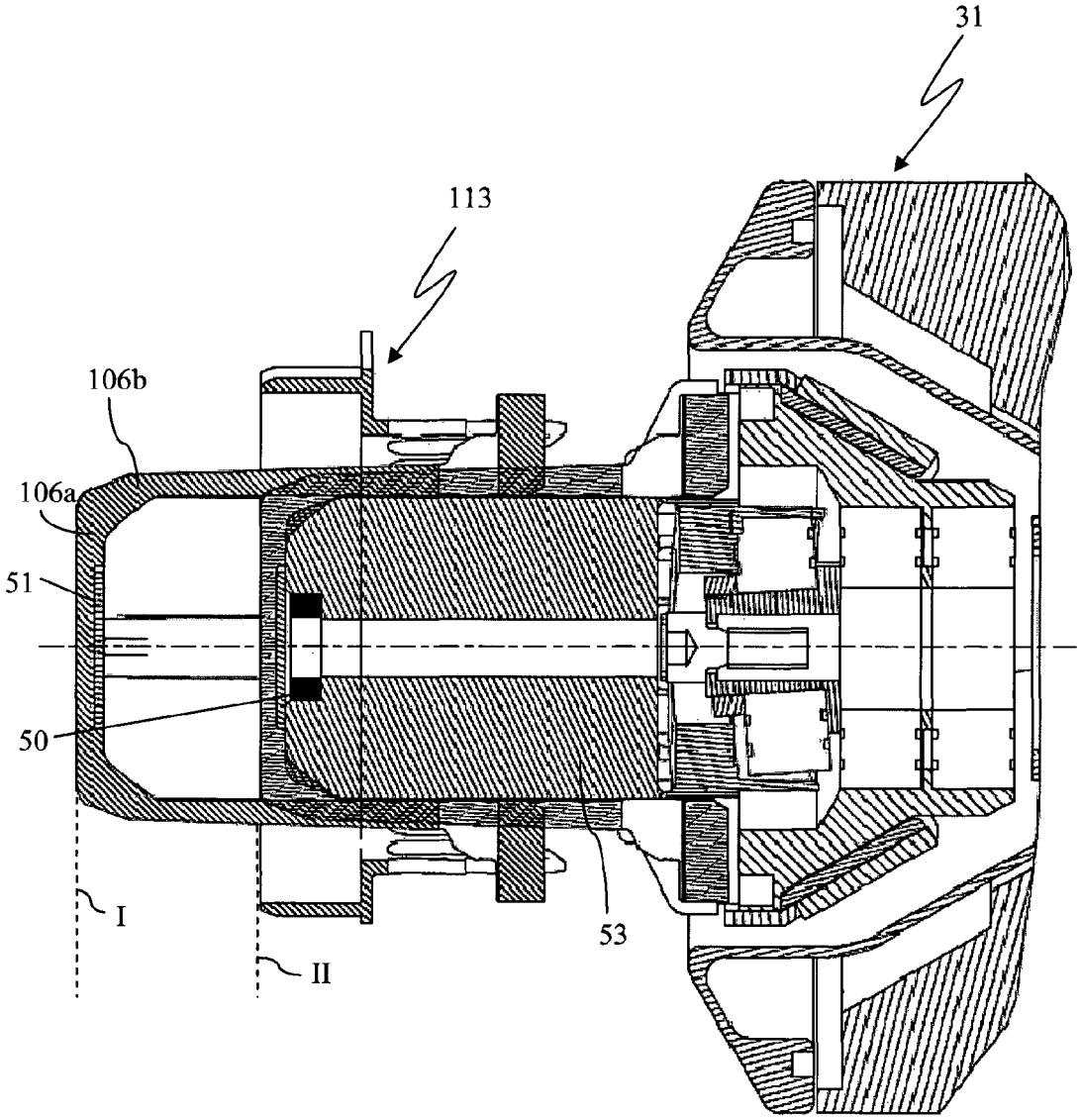

FIG. 13 shows the rest position (I) and the winding-up position (II) of the winding-up body (106).

In the rest position (I), the winding-up body (106) is locked in an end piece (113) which is fixedly connected to a yarn supply tube (2). In this position (I), no new yarn can be supplied.

The pushing-off pins (22) of the yarn loader (3) are now designed to move the winding-up body (106) from this rest position (I) to the winding-up position (H). This winding-up position (II) is situated only a few centimeters away from the rest position (I) in the longitudinal direction of the yarn supply tube (3), between 1 to 4 centimeters, preferably 2 or 3 cm.

Figure 14:
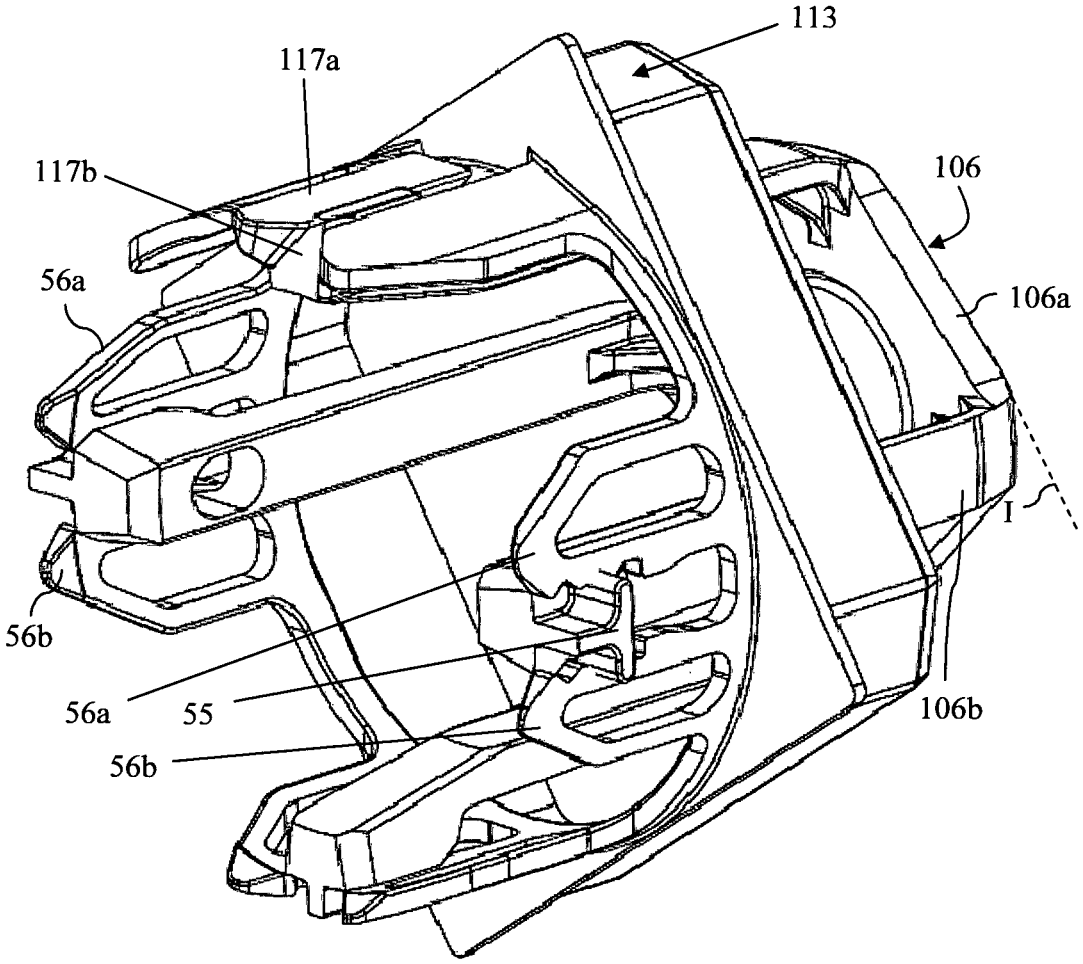

FIG. 14 shows the winding-up body in the rest position (I) in connection with an end piece of a yarn supply tube, without the yarn supply which is present. The winding-up body (106) and the end piece (113) are positioned in the rest position (I) with respect to each other by means of connecting means (55), (56) which make a change in the mutual position of the winding-up body (106) and the end piece (113) possible.

On the one hand, the winding-up body (106) comprises a respective T-shaped projection (55) at two diametrically opposite locations. On the other hand, the end piece (113) comprises a respective pair of two opposite fingers (56*a*), (56*b*), also at two diametrically opposite locations, between which an intermediate space is provided which extends along the axis of the yarn supply tube (2). The mutually facing flanks of these opposite fingers (56*a*), (56*b*) comprise a toothing. The position of the fingers and the intermediate distance between the fingers of each pair are such that each of the T-shaped projections (55) of the winding-up body (106) can be introduced into a respective intermediate space between a pair of fingers (56*a*), (56*b*) of the end piece (113). The T-shaped projections (55) are in this case held in a position between two successive teeth, so that the winding-up body (106) is locked in said rest position (I). Due to the fact that the fingers and/or the T-shaped projections (55) are elastically deformable, the position of the winding-up body (106) with respect to the end piece (113) can be changed, in which case the winding-up body (106) can be displaced along the axis of the supply tube (2). Due to this elastic deformability, the desired retaining force of this connection is also achieved and the winding-up body can be detached from the end piece.

In FIG. 14, the winding-up body (106) is provided with T-shaped projections (55), while the end piece (113) is provided with recesses. It is equally possible to do this the other way around. An embodiment in which the winding-up body (106) and the end piece (113) each comprise a combination of two or more types of connecting means (55), (56) is also possible.

FIG. 14 also shows the two cooperating parts (117*a*), (117*b*) of the positioning element. After the filling operation, the end part (16) of the yarn supply will be located between these two parts (117*a*), (117*b*) of the positioning element.

Figure 15:
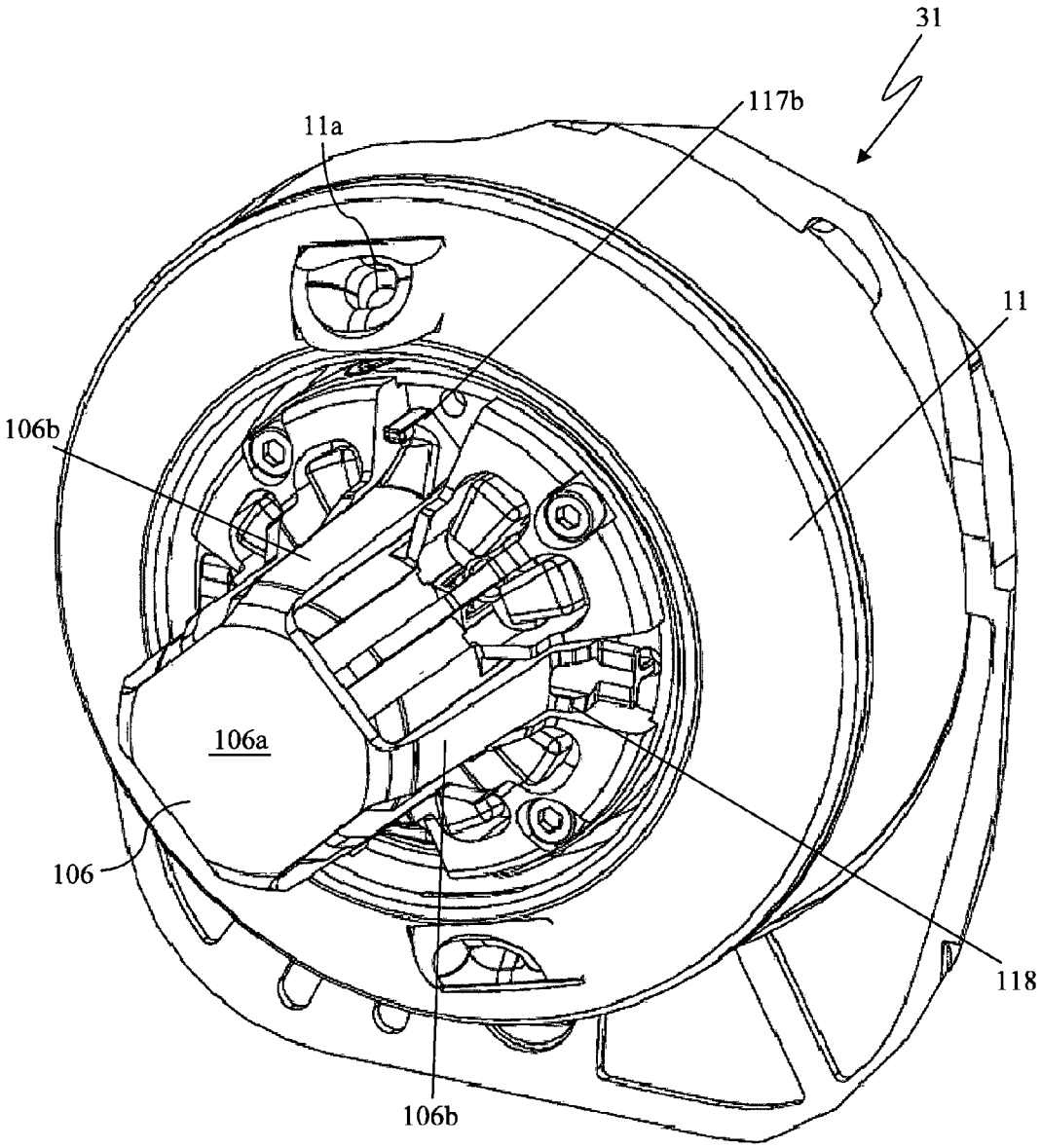
Figure 16:
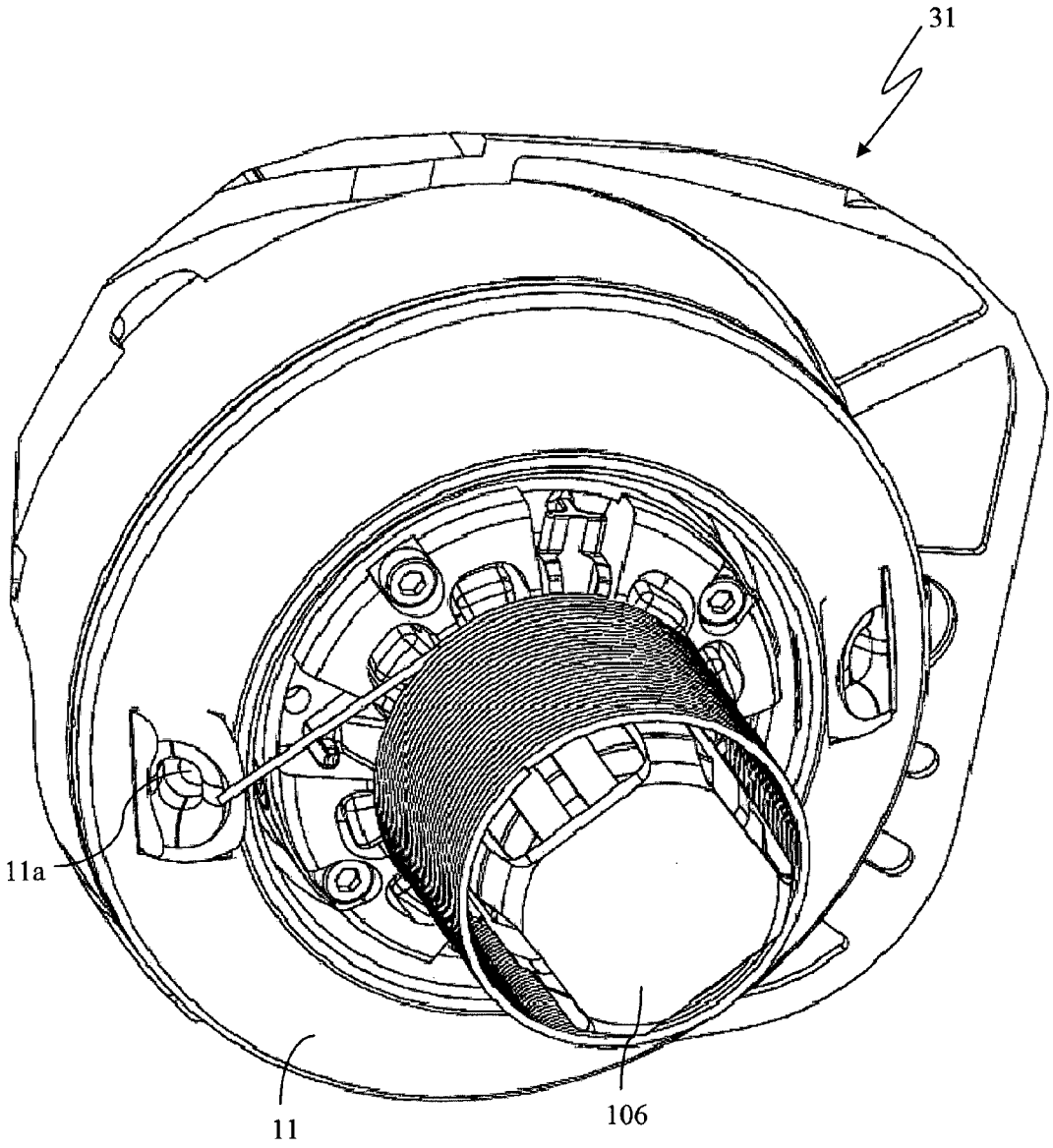

FIG. 15 shows how the removable winding-up body (106) is placed on the winding-up unit (31) in its winding position (II). In this position, the part (117*b*) of the positioning element (117) which is connected to the removable winding-up body (106) is situated behind the winding location which is determined by the steeply ascending inclined flanks (118) of the support part of the winding-up unit. If desired, these ascending flanks may also be (partly) provided on the removable winding-up body (106) itself. In any case, the winding-up body (106) is also provided with projecting parts which ensure that the supplied yarn is removed along with the winding-up body (106) when the winding-up body is removed from the winding-up unit (31). In the winding-up position (II) of the winding-up body (106), the projecting parts are also situated behind the winding location. This can also be seen in FIG. 16, which shows where the yarn is supplied.

Figure 17:
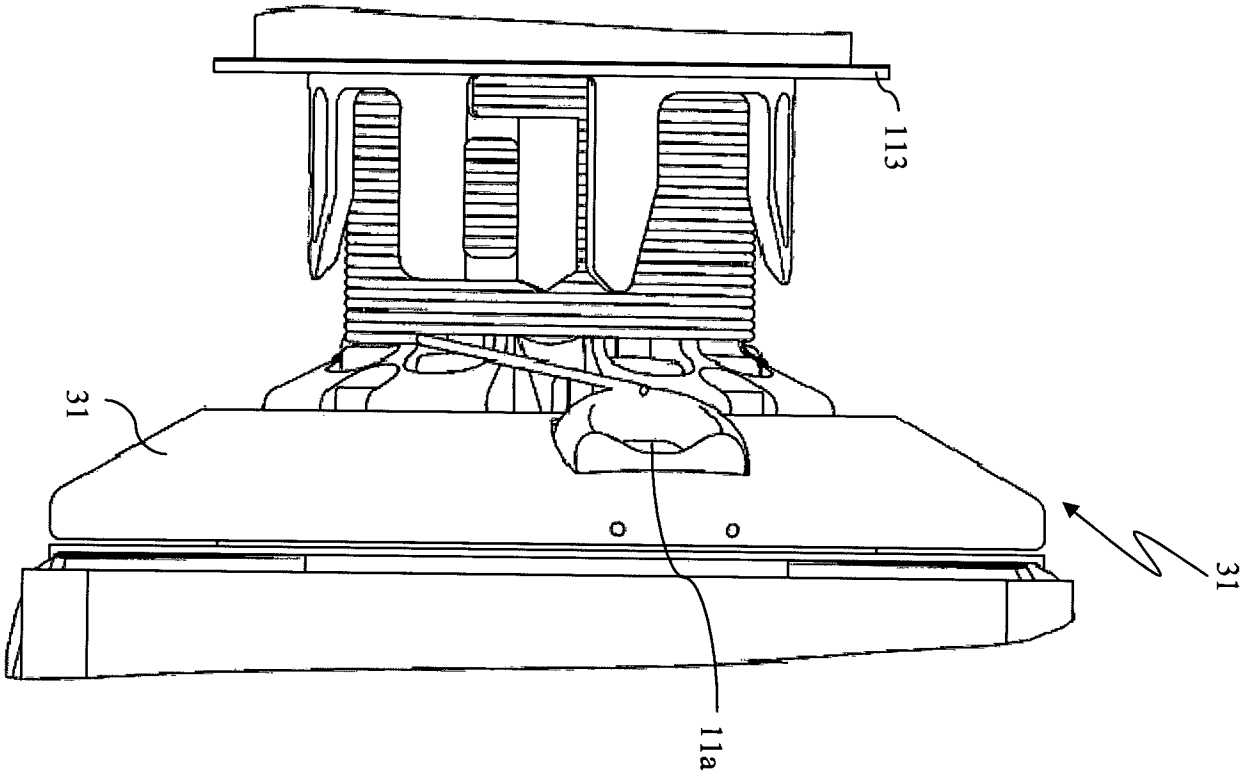

In FIG. 17, the associated end piece (113) can also be seen in its position with respect to winding-up unit (31) and the winding-up body (106) when the latter is in its winding-up position (II).

The method for replenishing the yarn supply in a yarn storage space in the embodiment from FIG. 12 et seq. can be described as follows:

1) The platform on which the yarn loader (3) is situated moves to a subsequent position in order to start the filling cycle of the yarn supply tube (2) which has been selected by the control program;
2) The sucking unit (43) moves to a position close to the positioning element (117*a*, 117*b*) of the selected yarn supply tube (2) on a rectilinear guide and sucks the end part (16) of the yarn supply (14) which is present therein into its suction opening (45) and pulls the yarn along in a direction opposite the direction which is indicated in FIG. 9 by arrow D;
3) The front gripper (39) takes the yarn-end part (16) between the positioning element (117*a*, 117*b*) and the suction opening (45) of the sucking unit (43), and moves it, for example, by means of a rotating movement, by means of a pneumatic or electric motor in such a manner that a yarn length from the yarn supply (14) which was already present is pulled from the yarn supply tube (2) and is placed in the connecting unit (38). At the same time, the end part of the yarn which comes from the external yarn supply is ready in the connecting unit (38), as it was placed here during a previous yarn supply cycle (see below);
4) The pistons of the connecting unit (38) are activated, after which the clamping element of the cutting and clamping unit (44) and the clamping element of the front gripper (39) are opened; as a result thereof, the yarn parts to be connected in the connecting unit (38) become taut.
5) The two yarns are connected in the connecting unit (38), while the waste originating from this connecting operation is sucked up by the waste remover (41) which, for example, consists of two suction lines which suck up the yarn parts which have been cut off after a knot has been tied and take these to the collecting point (42);
6) The blow-back unit (35) is switched on and sucks up the thread, so that it becomes taut. In this case, the yarn windings present in the yarn supply tube (2) are not sucked out of the storage space due to the fact that the yarn is still sufficiently well clamped in the positioning element (117).
7) If desired, a test is carried out at this point to test the connection. The means required for carrying this out are not specified.
8) The yarn loader is moved until the front part of the winding-up unit which acts as support for the winding-up body (106) is in line with the selected yarn supply tube (2);
9) The connecting unit (38) is meanwhile prepared for the next connecting operation;
10) The rotor (11) rotates the feed-through eye (11*a*) until the feed-through eye (11*a*) is at the top;
11) The winding-up unit (31) with its holder (53) is introduced into the opening of the winding-up body (106) and thus into the end piece (113) of the yarn supply tube (2) and placed in a position in which the winding-up body (106) which is present in the end piece is not yet completely placed in its winding-up position.
12) The pushing-off pins (22) are moved axially in the direction of the yarn supply tube (3), then radially towards the central axle of the winding-up unit into openings of the winding-up body (106), then axially away from the supply tube (3), after which they are moved radially back outwards. As a result thereof, the winding-up body (106) is removed from its associated end piece (113) and brought to the correct location for winding-up. On the winding-up unit (31), a magnet (50) is provided (at the location of the end point of the central axle) which cooperates with a magnetically influencable part (51) on the winding-up body (106). The magnet (50), for example, a permanent magnet, secures the position of the winding-up body (106) on the winding-up unit (31).
13) The blow-back unit (35) is switched off.
14) The intended number of windings is now wound onto the winding-up body (106) by rotating the feed-through eye (11*a*) in the winding-up direction of rotation. This winding-up takes place outside the storage space (2). The yarn windings are moved onto the winding-up body (106) as far as the part which is situated in the yarn supply tube (2); after all, while the yarn supply is being built up, the pushing elements (12) always push the parts of the yarn winding which have been added last forwards, so that these come to lie against the previous windings and so that the wound-up supply is being pushed forwards in the direction of the free end (7) of the winding-up body (106). The magnet (50) which keeps the winding-up body (106) in position with respect to the winding-up unit (31) supplies sufficient force to retain the winding-up body (106) while the yarn windings are being pushed forwards. During winding, the yarn is supplied from the external yarn supply via a supply tensioner (34) which provides the correct tension for producing the windings; if desired, this supply tensioner (34) may be controlled as a function of the properties of the yarn (100) to be supplied. Subsequently, the supplied yarn passes through the winding-up unit (31) in which case it initially runs along the central axis of rotation of the feed-through eye (11*a*) and then turns off into an oblique duct and runs to the feed-through eye (11*a*). The feed-through eye (11*a*) ultimately comes to a standstill at the top position.

15) After the desired amount of yarn has been laid, one of the pushing-off pins (22) (for example, the right-hand one) of the pushing-off mechanism (21) is moved radially in the direction of the central axle of the winding-up body (106), by means of a pneumatic piston or via a linear motor. This pin (22) goes beyond the diameter on which the yarn is wound up.

16) The feed-through eye (11*a*) then carries out a number of slow rotations (for example two) in a direction of rotation which is counter to the winding-up direction of rotation. In this case, the yarn is first bent around the pin (22) which has been introduced. The purpose of the supply which has thus been built up is to have a sufficient amount of yarn later for a subsequent connection operation. The feed-through eye comes to a standstill in a position laterally from and just beside the positioning element (117*a*), (117*b*). The last part of the yarn supply is now ready to be clamped between a part (117*b*) of the winding-up body (106) and a part (117*a*) of the end piece (113) when the winding-up body (106) is put back (this clamping over a certain length makes it possible to secure the direction of the end part (16) of the yarn supply in the yarn supply tube (2)).

17) Now, the remaining pushing-off pins (22) are also moved radially inwards. If desired, steps 15 to 17 may be replaced by other methods for producing a desired yarn supply for connecting; to this end, the pins can be moved in different sequences, in combination with associated changes in the direction of rotation of the winding-up unit. This may even lead to another direction of rotation for the normal winding-up direction of rotation.

18) The pushing-off pins (22) then move in the axial direction, along the length direction of the winding-up body (106), towards the free end (7) and push the winding-up body (106) with the windings which are present thereon into the end piece (113) of the yarn supply tube (2).

19) The feed-through eye (11*a*) is now rotated in the direction of rotation which is counter to the winding-up direction of rotation, just as far as to the top position of the feed-through eye (11*a*). As a result thereof, alignment of the end part (16) of the yarn supply in the positioning element (117) is improved.

20) The pushing-off pins (22) are returned to their original position, in which case they are first moved away from the axis of the winding-up body in the radial direction and then backwards in the axial direction, counter to the yarn supply direction.

21) The winding-up unit (31) and the components which are fixed thereto then move away from the yarn supply tube (2) again, while the yarn remains in the positioning element (117). The feed-through eye (11*a*) now continues to rotate in the direction of rotation counter to the winding-up direction of rotation so that the yarn comes to lie just above the connecting unit (38) which is accessible from above.

22) The yarn loader (3) then moves upwards, so that the yarn ends up in the cutting and clamping unit (44). The clamping element of the rear yarn gripper (40) grips the yarn which extends between the yarn supply tube (2) and the feed-through eye (11*a*) and places the yarn in the connecting unit (38).

23) Then, the yarn is cut and the part which is connected to the external yarn supply is held in a clamping manner in the clamping element of the cutting and clamping unit (44).

The invention claimed is:

1. Yarn storage device for a yarn-processing machine comprising at least two yarn storage spaces for storing a yarn supply, at least one yarn loader which is designed to be moved to a selected yarn storage space in order to connect an end of a yarn supply present in said yarn storage space to an end of an external yarn supply, and in order to add a certain amount of yarn in said yarn storage space, wherein each yarn loader is designed to first wind the yarn to be added onto a winding-up body and then to remove it from the winding-up body in the wound-up state and add it to the yarn storage space.

2. Yarn storage device according to claim 1, characterized in that each yarn storage space is associated with a respective winding-up body and in that the yarn loader is designed to wind yarn onto the winding-up body of the selected yarn storage space and to remove at least a part of the yarn which is wound onto said winding-up body from said winding-up body in the wound-up state, so that it is added to the yarn supply.

3. Yarn storage device according to claim 2, characterized in that the yarn loader comprises a holder for keeping a removable winding-up body in a winding-up position.

4. Yarn storage device according to claim 3, characterized in that the winding-up body comprises a winding-up sleeve around an interior space and an open side via which the holder can be introduced into said interior space in order to keep the winding-up body in the winding-up position.

5. Yarn storage device according to claim 2, characterized in that the yarn loader comprises an entrainment device which is designed to carry the winding-up body of a selected yarn storage space from a rest position in the yarn storage space to a winding-up position, and to place the winding-up body back into said rest position after yarn has been added to the yarn storage space.

6. Yarn storage device according to claim 2, characterized in that, in each yarn storage space, the winding-up body is connected to a fixed part of the yarn storage space in such a way that the winding-up body is axially displaceable between a rest position in which the winding-up body is substantially situated in the yarn storage space, in the passage via which the yarn is added, and a winding-up position which is axially displaced with respect to the rest position and in which a relatively large portion of the winding-up body is situated outside the yarn storage space, so that it is possible to wind up yarn.

7. Yarn storage device according to claim 2, characterized in that each yarn storage space comprises a positioner for positioning an end part of the yarn situated in the storage space, in that each winding-up body comprises a first part of the positioning means, in that the positioner comprises a second part which is fixedly arranged with respect to the yarn storage space, and in that the winding-up body is designed to be placed in such a position with respect to the yarn storage space that the first and the second part of the positioner extend next to one another in a mutual position, in which said end part of the yarn is held between said first and said second part.

8. Yarn storage device according to one of the preceding claims, characterized in that the yarn loader is designed to wind an amount of yarn onto the winding-up body, while the free end of the winding-up body is situated in the yarn storage space and in that, as new yarn windings are added to the winding-up body, the yarn windings which are already present on the winding-up body are moved towards the free end and are removed from the winding-up body and added to the yarn supply in the yarn storage space.

9. Yarn storage device according to claim 1, characterized in that the winding-up body is an intrinsic part of the yarn loader.

10. Yarn storage device according to claim 1, characterized in that the yarn loader comprises at least one pushing element, which is designed to move the wound-up yarn or a wound-up part thereof onto the winding-up body.

11. Yarn storage device according to claim 10, characterized in that each pushing element is designed to exert a substantially axially directed pushing force on the yarn.

12. Yarn storage device according to claim 10, characterized in that each pushing element is designed to move the yarn windings wound onto the winding-up body by in each case pushing against the yarn of the yarn winding which was wound up last.

13. Yarn storage device according to claim 12, characterized in that the yarn loader comprises two or more pushing elements which are designed to push, at in each case successive points in time, against successive parts of the yarn of the yarn winding which was wound up last.

14. Yarn storage device according to claim 1, characterized in that the winding-up body defines a winding surface for the yarn and a free end via which the wound-up yarn can be pushed off the winding surface, and in that the transverse dimensions of the winding surface decrease in the direction of said end.

15. Yarn storage device according to claim 14, characterized in that the winding surface is interrupted by at least two recesses which extend along the axis of the winding-up body.

16. Yarn storage device according to claim 14, characterized in that the winding-up body comprises a core and at least two ribs extending radially from the core with interposed recesses, and in that the end faces of said ribs form the winding surface for the yarn.

17. Yarn storage device according to claim 1, characterized in that the yarn loader comprises a yarn carrier which is rotatable about the fixed winding-up body or, if the winding-up body no longer is a fixed part of the yarn loader, about the winding-up body which is placed in the winding-up position, so that a yarn which is carried along by the yarn carrier is wound up onto the winding-up body by the rotating movement of the yarn carrier.

18. Yarn storage device according to claim 17, characterized in that each yarn storage space comprises a fixedly arranged positioner for the positioning of an end part of the yarn which is situated in the storage space, and in that the positioner is designed in such a manner that a yarn which extends between the yarn supply and the yarn carrier can be brought into cooperation with the positioning means by rotation of the yarn carrier.

19. Yarn storage device according to claim 18, characterized in that the positioner is designed in such a manner that a yarn which extends between the yarn supply and the yarn carrier can only be brought into cooperation with the positioner if the rotation of the yarn carrier has a direction of rotation which is counter to the winding-up direction of rotation.

20. Yarn storage device according to claim 1, characterized in that said device comprises at least one pushing-off device which is designed to push an amount of yarn off the winding-up body which has been wound on the winding-up body while retaining the yarn windings.

21. Yarn storage device according to claim 18, characterized in that the pushing device is provided with at least one pushing-off element which is displaceable in a recess of the winding-up body which extends along the axis.

22. Yarn storage device according to claim 1, characterized in that each yarn storage space comprises:

a passage via which the yarn is added, and a detainer having at least one detaining element which extends in the passage or in the vicinity of the passage and reduces the passage in such a manner that the yarn windings situated in the yarn storage space are kept in the yarn storage space.

23. Yarn storage device according to claim 22, characterized in that each detainer comprises at least one detaining element which, by exerting a pushing force thereon in the direction of introduction, is displaceable, pivotable or elastically deformable counter to a spring force and/or a force exerted by the yarn which is already present, in such a manner that at least a part of the winding-up body of the yarn loader can be introduced in the yarn storage space, and in that each detaining element moves back, rotates back or springs back, after said pushing force ceases, into a position in which it keeps the yarn windings in the storage space.

24. Yarn storage device according to claim 1, characterized in that it comprises a programmable control unit which is designed to automatically determine, on the basis of previously input data and/or signals received from a detector provided to this end, a sequence of yarn supply tubes to which yarn has to be added, and to automatically displace and actuate the yarn loader to effect the addition of yarn in accordance with said sequence.

25. Yarn-processing machine, provided with at least one yarn storage device which comprises at least two yarn supply tubes for storing a yarn supply and which comprises at least one yarn loader which is designed to be moved to a selected yarn storage space in order to connect an end of a yarn supply present in said yarn storage space to an end of an external yarn supply, and in order to add a certain amount of yarn in said yarn storage space, wherein each yarn storage device is a yarn storage device according to claim 1.

26. Yarn-processing machine, according to claim 25, characterized in that it is a weaving machine, a tufting machine, a knitting machine or a beaming machine.

27. Method for replenishing a yarn supply for a yarn-processing machine, in which a yarn supply is provided in at least two yarn supply tubes and in which the yarn supply is replenished in a selected yarn storage space by connecting an end of the yarn in said yarn storage space with an end of the yarn in an external yarn supply and then adding a certain amount of yarn in said yarn supply, wherein the yarn to be added is wound onto a winding-up body and is then removed from the winding-up body in the wound-up state and added to the yarn storage space.

28. Method for replenishing a yarn supply for a yarn-processing machine according to claim 27, characterized in that a winding-up body is associated with each yarn storage space, in that yarn is wound onto the winding-up body of the selected yarn storage space, and in that at least a part of the yarn wound onto said winding-up body is removed from said winding-up body in the wound-up state, so that it is added to the yarn supply.

29. Method for replenishing a yarn supply for a yarn-processing machine according to claim 28, characterized in that the winding-up body of a selected yarn storage space is carried along by an entrainment device of the yarn loader from a rest position in the yarn storage space to a winding-up position, and in that the winding-up body is placed back into said rest position after yarn has been added to the yarn storage space.

30. Method for replenishing a yarn supply for a yarn-processing machine according to claim 27, characterized in that the yarn is wound onto the winding-up body at a location which is situated outside the yarn storage space.

31. Method for replenishing a yarn supply for a yarn-processing machine according to claim 27, characterized in that the wound-up yarn is displaced on the winding-up body as further additional yarn is being wound up.

32. Method for replenishing a yarn supply for a yarn-processing machine according to claim 31, characterized in that the wound-up yarn is pushed off the winding-up body as a result of its displacement and added in the yarn storage space and in the process pushes the yarn supply which is present in the yarn storage space forward.

33. Method for replenishing a yarn supply for a yarn-processing machine according to claim 31, characterized in that an amount of yarn is wound onto the winding-up body while the free end of the winding-up body is situated in the yarn storage space, and in that, as new yarn windings are added to the winding-up body, the yarn windings which are already present on the winding-up body are moved towards the free end and are removed from the winding-up body and added to the yarn supply in the yarn storage space.

* * * * *